US009915895B2

(12) United States Patent
Eto

(10) Patent No.: US 9,915,895 B2
(45) Date of Patent: Mar. 13, 2018

(54) DEVELOPER STORAGE CONTAINER AND IMAGE FORMING DEVICE EQUIPPED WITH SAME

(71) Applicant: KYOCERA Document Solutions Inc., Osaka, Osaka (JP)

(72) Inventor: Daisuke Eto, Osaka (JP)

(73) Assignee: KYOCERA DOCUMENT SOLUTIONS INC., Osaka-shi, Osaka (JP)

( * ) Notice: Subject to any disclaimer, the term of this patent is extended or adjusted under 35 U.S.C. 154(b) by 0 days.

(21) Appl. No.: 15/311,639

(22) PCT Filed: Jun. 17, 2015

(86) PCT No.: PCT/JP2015/067489
§ 371 (c)(1),
(2) Date: Nov. 16, 2016

(87) PCT Pub. No.: WO2016/017312
PCT Pub. Date: Feb. 4, 2016

(65) Prior Publication Data

US 2017/0090348 A1 Mar. 30, 2017

(30) Foreign Application Priority Data

Jul. 30, 2014 (JP) ..... 2014-154762

(51) Int. Cl.
*G03G 15/08* (2006.01)

(52) U.S. Cl.
CPC ..... *G03G 15/0889* (2013.01)

(58) Field of Classification Search
None
See application file for complete search history.

(56) References Cited

U.S. PATENT DOCUMENTS

2009/0269112 A1 10/2009 Fukunaga et al.
2014/0079439 A1 3/2014 Abler et al.
2014/0079441 A1* 3/2014 Abler ..... G03G 15/0875 399/262

FOREIGN PATENT DOCUMENTS

JP 2000-187382 7/2000
JP 2001-92230 4/2001
(Continued)

OTHER PUBLICATIONS

Extended European Search Report dated May 9, 2017.
International Search Report of Sep. 8, 2015.

*Primary Examiner* — Victor Verbitsky
(74) *Attorney, Agent, or Firm* — Gerald E. Hespos; Michael J. Porco; Matthew T. Hespos

(57) ABSTRACT

A developer storage container (30) includes a container body (37), a developer discharge port (377), a movable wall (32) and a stirring member (35). The movable wall moves in a first direction in an internal space from an initial position on one end side in the first direction to a final position on the other end side while conveying developer in a container space toward the developer discharge port. At the final position of the movable wall, an upstream end portion of an outer circumferential portion of the movable wall in the first direction is disposed upstream, in the first direction, of an upstream end portion of the developer discharge port in the first direction and a conveying surface of the movable wall is disposed at a distance from the stirring member.

10 Claims, 25 Drawing Sheets

(56) References Cited

FOREIGN PATENT DOCUMENTS

| | | |
|---|---|---|
| JP | 2003-280344 | 10/2003 |
| JP | 2007-212766 | 8/2007 |
| JP | 2009-265395 | 11/2009 |
| JP | 2014-102461 | 6/2014 |

* cited by examiner

DEVELOPER STORAGE CONTAINER AND IMAGE FORMING DEVICE EQUIPPED WITH SAME

TECHNICAL FIELD

The present invention relates to a developer storage container for containing developer inside and an image forming device equipped with the same.

BACKGROUND ART

Conventionally, a toner container as described in Japanese Unexamined Patent Publication No. 2003-280344 is known as a developer storage container for containing developer inside. This toner container includes a toner discharge port and a rotational stirring member. By the rotation of the stirring member, toner is discharged through the toner discharge port.

Further, a waste toner container for containing developer inside is disclosed in Japanese Unexamined Patent Publication No. 2009-265395. The waste toner container includes a hollow cylindrical container body and a spiral groove formed on an outer circumferential part of the container body. When the container body is rotated, collected toner is conveyed toward one end side of the container body along the spiral groove.

Since the toner remains in an area where a rotational force of a conveying member does not act in the toner container described in Japanese Unexamined Patent Publication No. 2003-280344, it has been difficult to use up the toner contained inside. Further, even if a technique of the waste toner container described in Japanese Unexamined Patent Publication No. 2009-265395 is applied to a toner container, toner adhering to a groove continues to rotate together with a container body. Thus, there has been a problem that the toner remains in the container body.

The present invention aims to provide a developer storage container having a reduced amount of developer remaining inside a container body at the end of use and an image forming device equipped with the same.

SUMMARY OF INVENTION

A developer storage container according to one aspect of the present invention includes a container body including an inner circumferential portion defining a tubular internal space extending along a first direction and a wall portion defining one end surface of the internal space in the first direction, a facing wall portion configured to be mounted on an end portion of the container body opposite to the wall portion in the first direction so as to close the internal space, a developer discharge port disposed adjacent to the facing wall portion or the wall portion in the first direction, opened in the container body to communicate with the internal circumferential portion and configured to discharge developer, a movable wall including an outer circumferential portion disposed in close contact with the inner circumferential portion of the container body and a conveying surface defining a container space for containing the developer in cooperation with the inner circumferential portion of the container body, and the movable wall being configured to move in the first direction in the internal space from an initial position on one end side in the first direction to a final position on the other end side while conveying the developer in the container space toward the developer discharge port, and a stirring member configured to stir the developer in the container space around the developer discharge port. At the final position of the movable wall, an upstream end portion of the outer circumferential portion of the movable wall in the first direction is disposed upstream, in the first direction, of an upstream end portion of the developer discharge port in the first direction and the conveying surface of the movable wall is disposed at a distance from the stirring member.

An image forming device according to another aspect of the present invention includes the above developer storage container, an image carrier having a surface for allowing an electrostatic latent image to be formed thereon and configured to carry a developer image, a developing device configured to supply the developer supplied from the developer storage container to the image carrier, and a transfer section configured to transfer the developer image to a sheet from the image carrier.

According to the present invention, the developer storage container having a reduced amount of the developer remaining in the container body at the end of use and the image forming device equipped with the same are provided. Further, when the movable wall reaches the final position, the developer discharged through the developer discharge port is prevented from erroneously flowing into the internal space upstream of the movable wall.

DESCRIPTION OF EMBODIMENT

Figure 1:
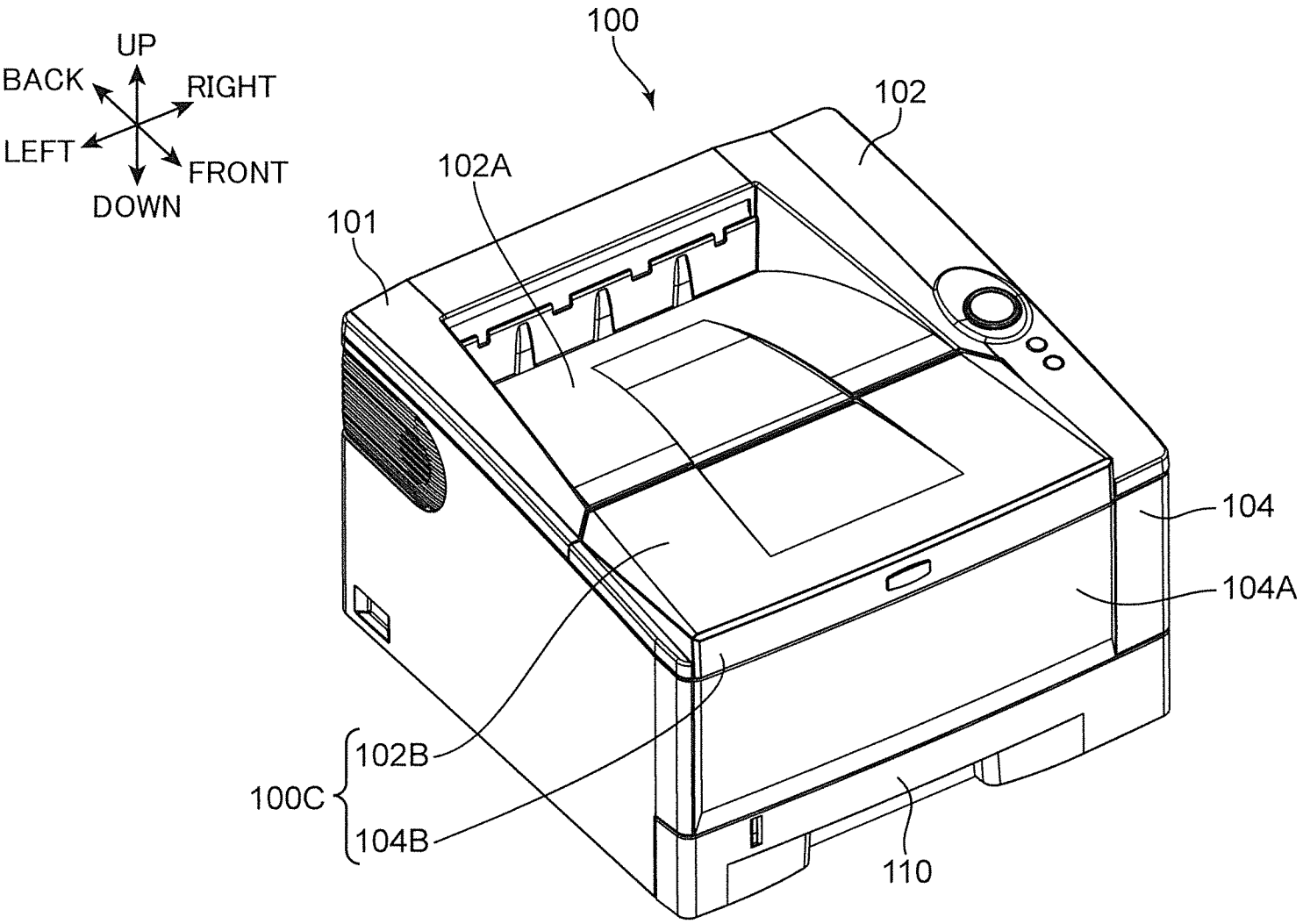
FIG. 1 is a perspective view showing an image forming device according to one embodiment of the present invention.
Figure 2:
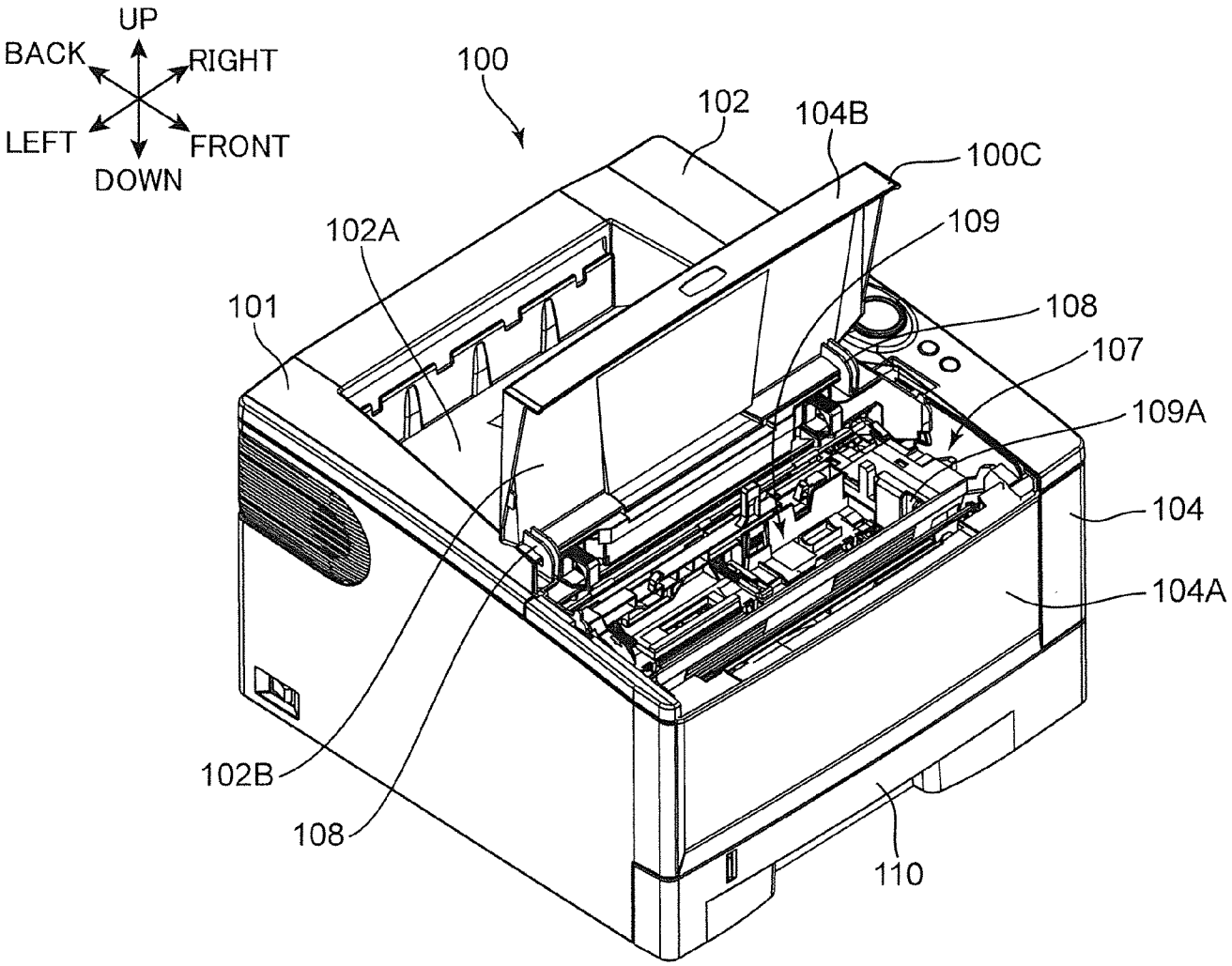
FIG. 2 is a perspective view showing a state where a part of the image forming device according to the one embodiment of the invention is opened.
Figure 3:
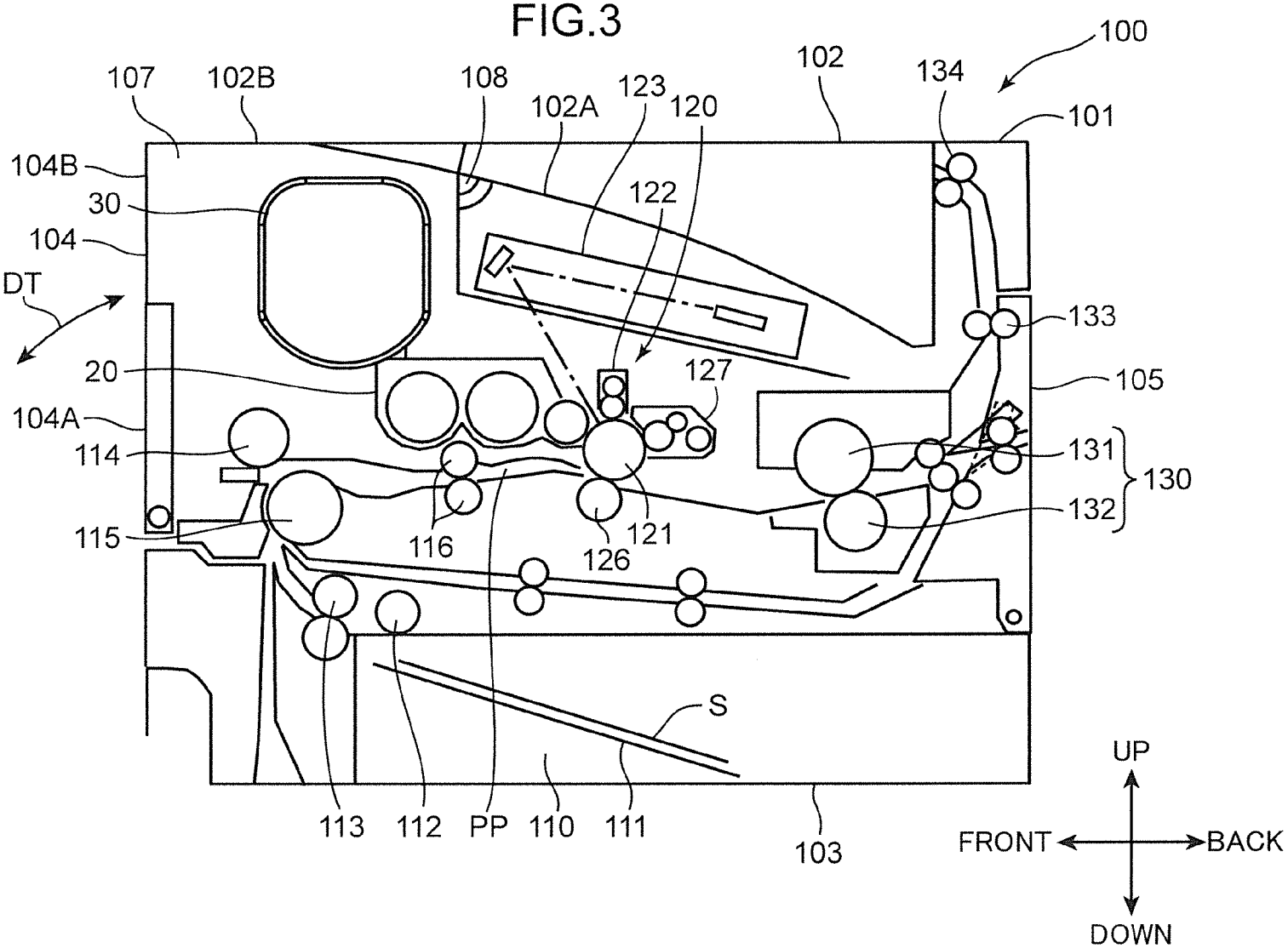
FIG. 3 is a schematic sectional view showing an internal structure of the image forming device according to the one embodiment of the present invention.

Hereinafter, one embodiment of the present invention will be described with reference to the accompanying drawings. FIGS. 1 and 2 are perspective views of a printer 100 (image forming device) according to the one embodiment of the present invention. FIG. 3 is a schematic sectional view showing an internal structure of the printer 100 shown in FIGS. 1 and 2. The printer 100 as an image forming device shown in FIGS. 1 to 3 is a so-called monochrome printer, but may be another device for forming a toner image on a sheet such as a color printer, a facsimile machine or a complex machine provided with these functions. It should be noted that terms indicating directions such as "top", "bottom", "front", "back", "left" and "right" used in the following description are intended merely for descriptive purposes, and not for limiting the principle of the image forming device.

The printer 100 includes a housing 101 for housing various components for forming an image on a sheet S. The housing 101 includes a top wall 102 defining the top surface of the housing 101, a bottom wall 103 (FIG. 3) defining the bottom surface of the housing 101, a main body rear wall 105 (FIG. 3) between the top wall 102 and the bottom wall 103, and a main body front wall 104 located in front of the main body rear wall 105. The housing 101 includes a main body internal space 107 where various components are arranged. A sheet conveyance passage PP extends in the main body internal space 107 of the housing 101, the sheet conveyance passage PP for allowing passage of a sheet S in a predetermined conveying direction. Further, the printer 100 includes an opening/closing cover 100C mounted on the housing 101 in an openable and closable manner.

The opening/closing cover 100C is composed of a front wall upper portion 104B constituting an upper part of the main body front wall 104, and a top wall front portion 102B constituting a front part of the top wall 102. Further, the opening/closing cover 100C is vertically openable and closable with an unillustrated hinge shaft arranged on a pair of arm portions 108 arranged on opposite lateral end portions acting as a fulcrum (FIG. 2). In an open state of the opening/closing cover 100C, an upper part of the main body internal space 107 is open to outside. On the other hand, in a closed state of the opening/closing cover 200C, the upper part of the main body internal space 107 is closed.

A sheet discharge section 102A is disposed in a central part of the top wall 102. The sheet discharge section 102A includes an oblique surface sloping downward from a front part to a rear part of the top wall 102. A sheet S that has been subjected to image formation in an image forming section 120 to be described later is discharged onto the sheet discharge section 102A. Further, a manual feed tray 104A is disposed in a vertically central part of the main body front wall 104. The manual feed tray 104A is vertically pivotable with a lower end thereof acting as a fulcrum (arrow DT shown in FIG. 3).

With reference to FIG. 3, the printer 100 includes a cassette 110, a pickup roller 112, a first sheet feeder roller 113, a second sheet feeder roller 114, a conveyor roller 115, a pair of registration rollers 116, the image forming section 120, and a fixing device 130.

The cassette 110 stores sheets S therein. The cassette 110 includes a lift plate 111. When the pickup roller 112 rotates, a sheet S is pulled out from the cassette 110. The first sheet feeder roller 113 is disposed downstream of the pickup roller 112 and conveys a sheet S further downstream. The second sheet feeder roller 114 draws a sheet S placed on the manual feed tray 104A into the housing 101. The conveyor roller 115 conveys a sheet S fed by the first sheet feeder roller 113 or the second sheet feeder roller 114 further downstream. The pair of registration rollers 116 function to correct the oblique feed of a sheet S.

The image forming section 120 includes a photoconductive drum 121 (image carrier), a charger 122, an exposure device 123, a developing device 20, a toner container 30 (developer storage container), a transfer roller 126 (transfer section), and a cleaning device 127.

The photoconductive drum 121 has a surface for allowing an electrostatic latent image to be formed thereon, and carries a toner image (developer image) corresponding to the electrostatic latent image on the surface. The charger 122 charges the circumferential surface of the photoconductive drum 121 substantially uniformly. The exposure device 123 irradiates the circumferential surface of the photoconductive drum 121 charged by the charger 122 with beams of laser light. The developing device 20 supplies toner to the circumferential surface of the photoconductive drum 121 having an electrostatic latent image formed thereon. The toner container 30 supplies toner to the developing device 20. The toner container 30 is detachably attached to the developing device 20. Upon supply of the toner from the developing device 20 to the photoconductive drum 121, a toner image (developer image) is formed on the circumferential surface of the photoconductive drum 121.

The transfer roller 126 defines a transfer nip in cooperation with the photoconductive drum 121 for transferring a toner image onto a sheet S. The cleaning device 127 removes toner remaining on the circumferential surface of the photoconductive drum 121 after a toner image is transferred onto a sheet S. The fixing device 130 includes a heating roller 131 for melting toner on a sheet S and a pressure roller 132 for bringing the sheet S into close contact with the heating roller 131, and fixes the toner image on the sheet S.

The printer 100 further includes a pair of conveyor rollers 133 disposed downstream of the fixing device 130, and a pair of discharge rollers 134 disposed downstream of the pair of conveyor rollers 133. A sheet S is conveyed upward by the pair of conveyor rollers 133 to be finally discharged from the housing 101 by the pair of discharge rollers 134. The sheet S discharged from the housing 101 is placed on the sheet discharge section 102A.

<Concerning Developing Device>

Figure 4:
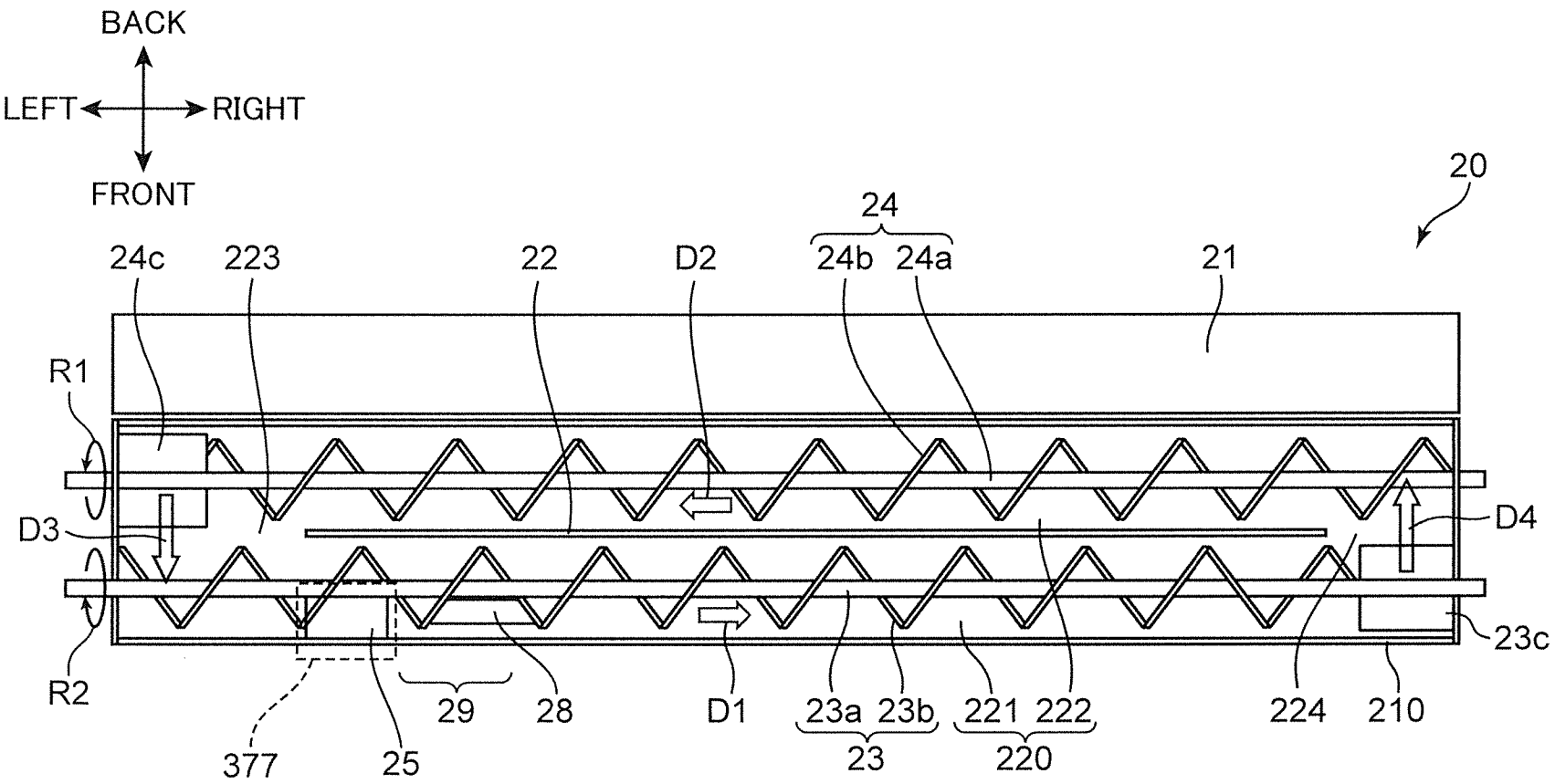
FIG. 4 is a schematic plan view showing an internal structure of a developing device according to the one embodiment of the present invention.

FIG. 4 is a plan view showing an internal structure of the developing device 20. The developing device 20 includes a development housing 210 (housing) in the form of a box having a longer dimension in one direction (axial direction of a developing roller 21 or lateral direction). The development housing 210 includes a storage space 220. In the storage space 220, there are disposed the developing roller 21, a first stirring screw 23 (developer conveying member), a second stirring screw 24, and a toner replenishment port 25. The present embodiment employs a one-component developing method and this storage space 220 is filled with toner as developer. On the other hand, in the case of a two-component developing method, a mixture of toner and carrier made of a magnetic material is filled as developer. In the storage space 220, the toner is stirred and conveyed and successively supplied from the developing roller 21 to the photoconductive drum 121 to develop an electrostatic latent image.

The developing roller 21 has a hollow cylindrical shape extending in the longitudinal direction of the development housing 210, and includes a sleeve configured to be rotationally driven on the outer periphery.

The storage space 220 of the development housing 210 is covered by an unillustrated top plate and divided into a first conveyance passage 221 and a second conveyance passage 222 long in the lateral direction by a partition plate 22 extending in the lateral direction. The partition plate 22 is shorter than a lateral width of the development housing 210 to define a first communication passage 223 and a second communication passage 224 respectively at the left and right ends of the partition plate 22, the first and second communication passages 223 and 224 allowing communication between the first conveyance passage 221 and the second conveyance passage 222. In this way, a circulation passage constituted by the first conveyance passage 221, the second communication passage 224, the second conveyance passage 222, and the first communication passage 223 is formed in the storage space 220. Toner is conveyed counterclockwise in this circulation passage in FIG. 4.

The toner replenishment port 25 (developer replenishment port) is an opening formed in the top plate of the development housing 210, and is disposed above and near the left end of the first conveyance passage 221. The toner replenishment port 25 is arranged to face the above-mentioned circulation passage, and functions to allow replenishment toner (replenishment developer) supplied through a toner discharge port 377 of the toner container 30 to flow into the storage space 220.

The first stirring screw 23 is disposed in the first conveyance passage 221. The first stirring screw 23 includes a first rotary shaft 23*a*, and a first spiral blade 23*b* (screw blade) in the form of a spiral protrusion formed on the circumferential surface of the first rotary shaft 23*a*. The first stirring screw 23 is driven to rotate about the first rotary shaft 23*a* (arrow R2) to convey toner in a direction of an arrow D1 of FIG. 4. The first stirring screw 23 conveys the developer so that the developer passes a position where the toner replenishment port 25 faces the first conveyance passage 221. In this way, the first stirring screw 23 functions to convey new toner flowing into through the toner replenishment port 25 and toner conveyed to the first conveyance passage 221 from the second conveyance passage 222 while mixing them. A first paddle 23*c* is disposed downstream of the first stirring screw 23 in a toner conveying direction (direction D1). The first paddle is a plate-like member disposed on the first rotary shaft 23*a*. The first paddle 23*c* is rotated together with the first rotary shaft 23*a* to transfer the toner in a direction of an arrow D4 of FIG. 4 from the first conveyance passage 221 to the second conveyance passage 222.

The second stirring screw 24 is disposed in the second conveyance passage 222. The second stirring screw 24 includes a second rotary shaft 24*a*, and a second spiral blade 24*b* in the form of a spiral protrusion formed on the circumferential surface of the second rotary shaft 24*a*. The second stirring screw 24 is driven to rotate about the second rotary shaft 24*a* (arrow R1) to supply the toner to the developing roller 21 while conveying the toner in a direction of an arrow D2 of FIG. 4. A second paddle 24*c* is disposed downstream of the second stirring screw 24 in a toner conveying direction (direction D2). The second paddle 24 transfers the toner from the second conveyance passage 222 to the first conveyance passage 221 in a direction of an arrow D3 of FIG. 4.

The toner container 30 (FIG. 3) is disposed above the toner replenishment port 25 of the development housing 210. The toner container 30 includes the toner discharge port 377 (FIG. 4). The toner discharge port 377 is disposed at a bottom portion 371 (FIG. 8B) of the toner container 30 and corresponds to the toner replenishment port 25 of the development housing 20. The toner falling through the toner discharge port 377 is supplied from the toner replenishment port 25 to the development device 20.

<Concerning Supply of Toner>

Figure 5:
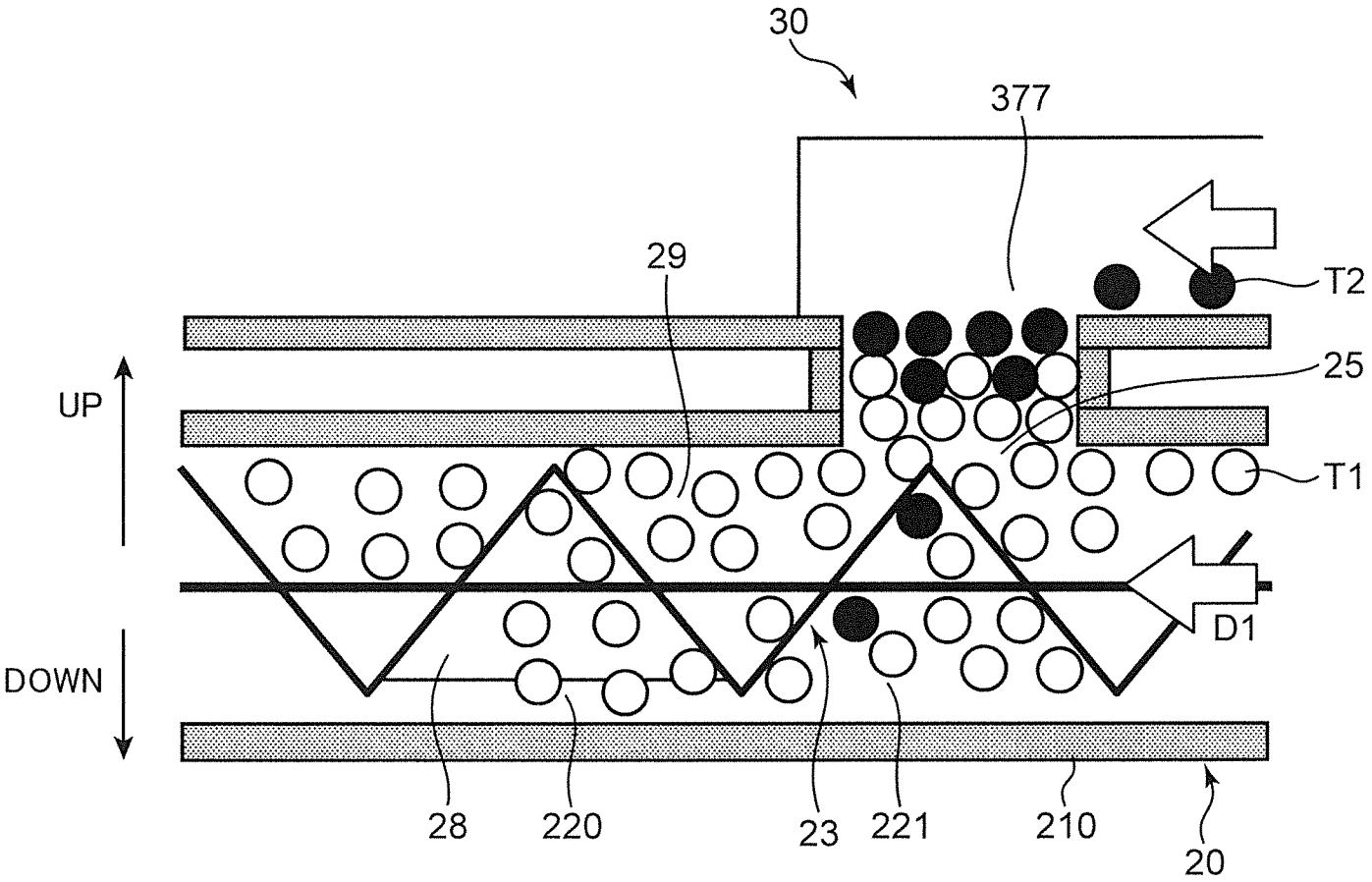
FIG. 5 is a schematic sectional view showing a state where developer is supplied to the developing device according to the one embodiment of the present invention.

Next, the flow of toner newly supplied through the toner replenishment port 25 is described. FIG. 5 is a sectional view of the vicinity of the toner replenishment port 25 disposed in the developing device 20 and the toner discharge port 377 disposed in the toner container 30.

Replenishment toner T2 supplied through the toner discharge port 377 of the toner container 30 falls into the first conveyance passage 221 to be mixed with existing toner T1, and the mixture of toners T1 and T2 is conveyed in the direction of the arrow D1 by the first stirring screw 23. At this time, the toners T1 and T2 are stirred and charged.

The first stirring screw 23 includes a reducing paddle 28 (conveying ability reducing portion) disposed downstream of the toner replenishment port 25 in the toner conveying direction, the reducing paddle for partially reducing the ability of conveying toner. In the present embodiment, the reducing paddle 28 is a plate-like member disposed between adjacent parts of the first spiral blade 23*b* of the first stirring screw 23. The reducing paddle 28 rotates about the first rotary shaft 23*a* to cause the toner being conveyed from a side upstream of the reducing paddle 28 to begin to accumulate. The accumulation of the toner grows up to a position which is immediately upstream of the reducing paddle 28 and where the toner replenishment port 25 faces the first conveyance passage 221. As a result, an accumulation portion 29 of developer (developer accumulation portion) is formed near the inlet of the toner replenishment port 25.

When the replenishment toner T2 is supplied from the toner replenishment port 25 and the amount of the toner in the storage space 220 increases, the toner accumulated in the accumulation portion 29 closes (seals) the toner replenishment port 25 to prevent further supply of the toner. Thereafter, as the toner in the accumulation portion 29 decreases in amount because of consumption of the toner in the storage space 220 by the developing roller 21, the amount of the toner closing the toner replenishment port 25 decreases such that a gap appears between the accumulation portion 29 and the toner replenishment port 25. As a result, the replenishment toner T2 flows into the storage space 220 through the toner replenishment port 25 again. In this manner, the present embodiment employs a volume replenishment type toner supply method in which the amount of replenishment toner to be received is adjusted in accordance with a decrease in the amount of the toner accumulated in the accumulation portion 29.

<Concerning Attachment of Toner Container to Developing Device>

Figure 6:
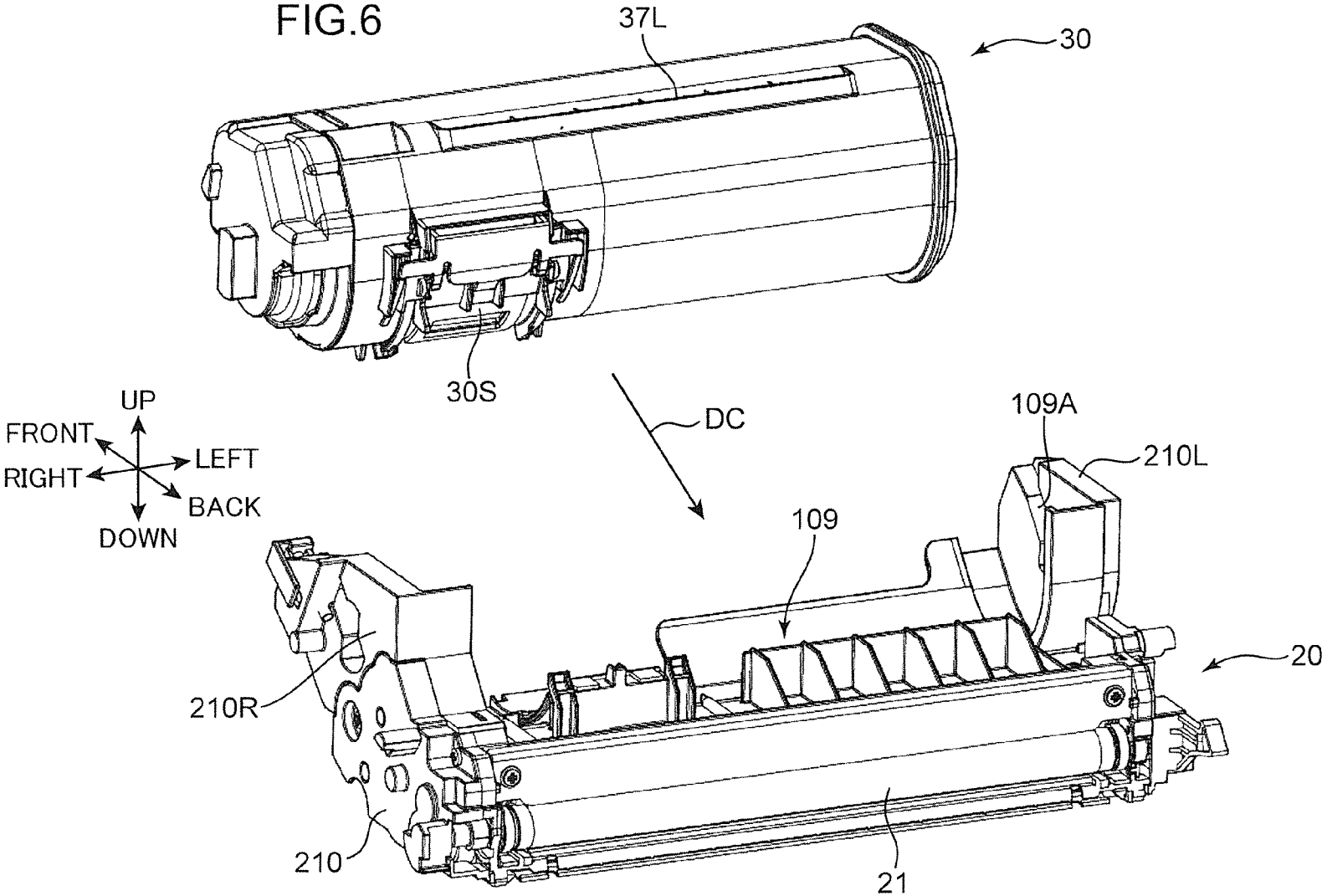
FIG. 6 is a perspective view of a developer storage container and the developing device according to the embodiment of the present invention.
Figure 7:
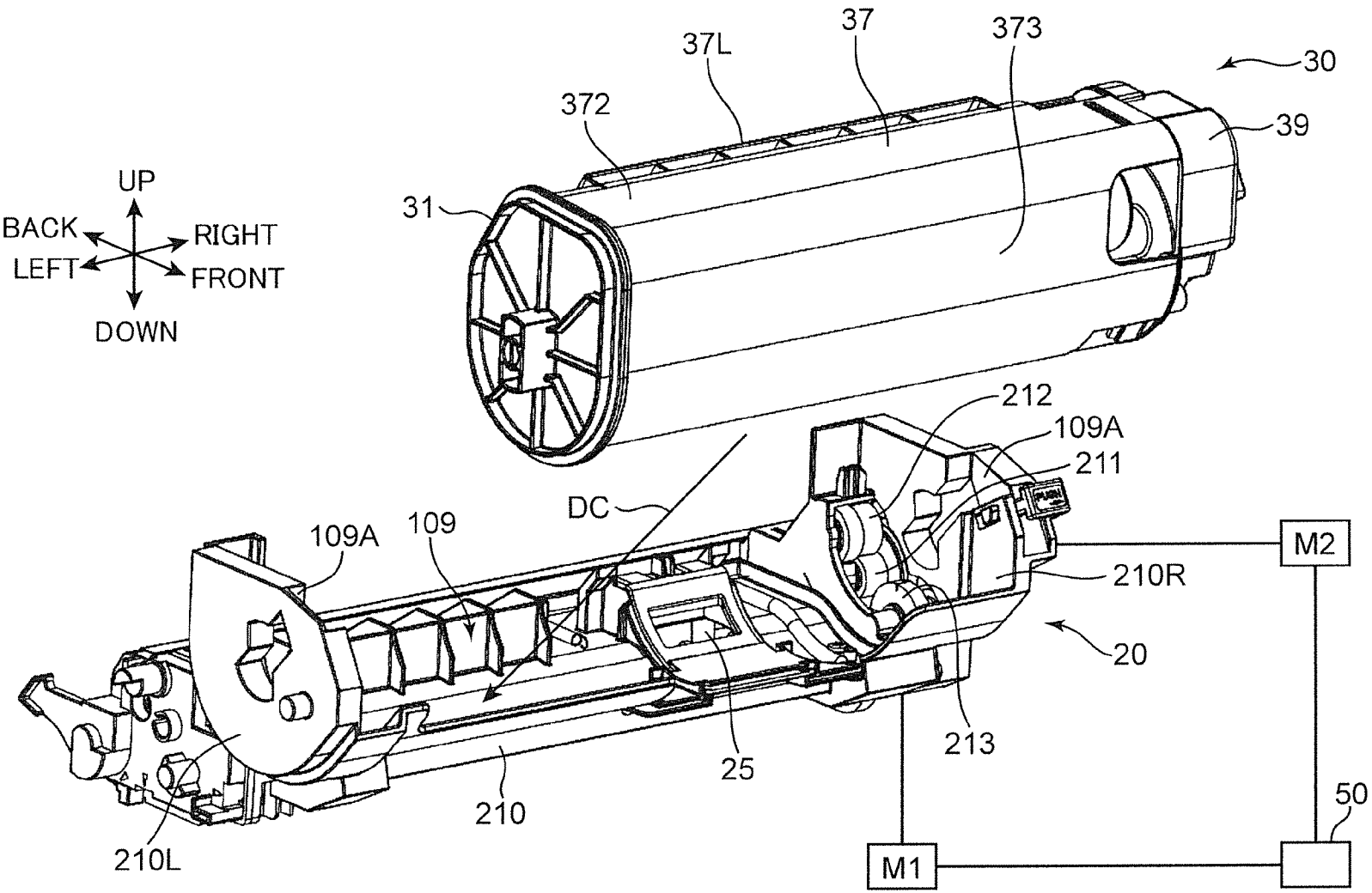
FIG. 7 is a perspective view of the developer storage container and the developing device according to the embodiment of the present invention.

FIGS. 6 and 7 are perspective views of the toner container 30 and the developing device 20 according to the present embodiment. The toner container 30 is detachably attachable to the developing device 20 in the housing 101. With reference to FIG. 2, when the opening/closing cover 100C of the housing 101 is opened upward, a container housing portion 109 provided in the development housing 210 of the developing device 20 is exposed to the outside of the housing 101. With reference to FIGS. 6 and 7, the development housing 210 includes a pair of a housing left wall 210L and a housing right wall 210R. The container housing portion 109 is formed between the housing left wall 210L and the housing right wall 210R. In the present embodiment, the toner container 30 is mounted into the container housing portion 109 substantially from above (see arrow DC of FIGS. 6 and 7). At this time, a later-described cover 39 of the toner container 30 is arranged on the side of the housing right wall 210R and a later-described lid 31 of the toner container 30 is arranged on the side of the housing left wall 210L. The development housing 210 includes a pair of guide grooves 109A (FIG. 7). The guide grooves 109A are groove parts formed in the housing left wall 210L and the housing right wall 210R.

Further, with reference to FIG. 7, the developing device 20 includes a first transmission gear 211, a second transmission gear 212 and a third transmission gear 213. Further, the printer 100 includes a first motor M1, a second motor M2 and a controller 50 provided in the housing 101. The first, second and third transmission gears 211, 212 and 213 are gears rotatably supported on the housing right wall 210R. The first transmission gear 211 is coupled to the second transmission gear 212. Further, the first transmission gear 211 is coupled to the developing roller 21, the first stirring screw 23 and the second stirring screw 24 via an unillustrated gear set. When the developing device 20 is mounted into the housing 101, the first motor M1 is coupled to the third transmission gear 213 and the second motor M2 is coupled to the first transmission gear 211.

The first motor M1 moves a later-described movable wall 32 of the toner container 30 by rotating a later-described shaft 33 of the toner container 30 via the third transmission gear 213. The second motor M2 rotates the developing roller 20, the first stirring screw 23 and the second stirring screw 24 of the developing device 20 via the first transmission gear 211. Further, the second motor M2 rotates a later-described stirring member 35 of the toner container 30 via the first and second transmission gears 211, 212. The controller 50 drives each member of the developing device 20 and the toner container 30 by controlling each of the first and second motors M1, M2 such as during a printing operation of the printer 100.

<Concerning Structure of Toner Container>

Figure 8A:
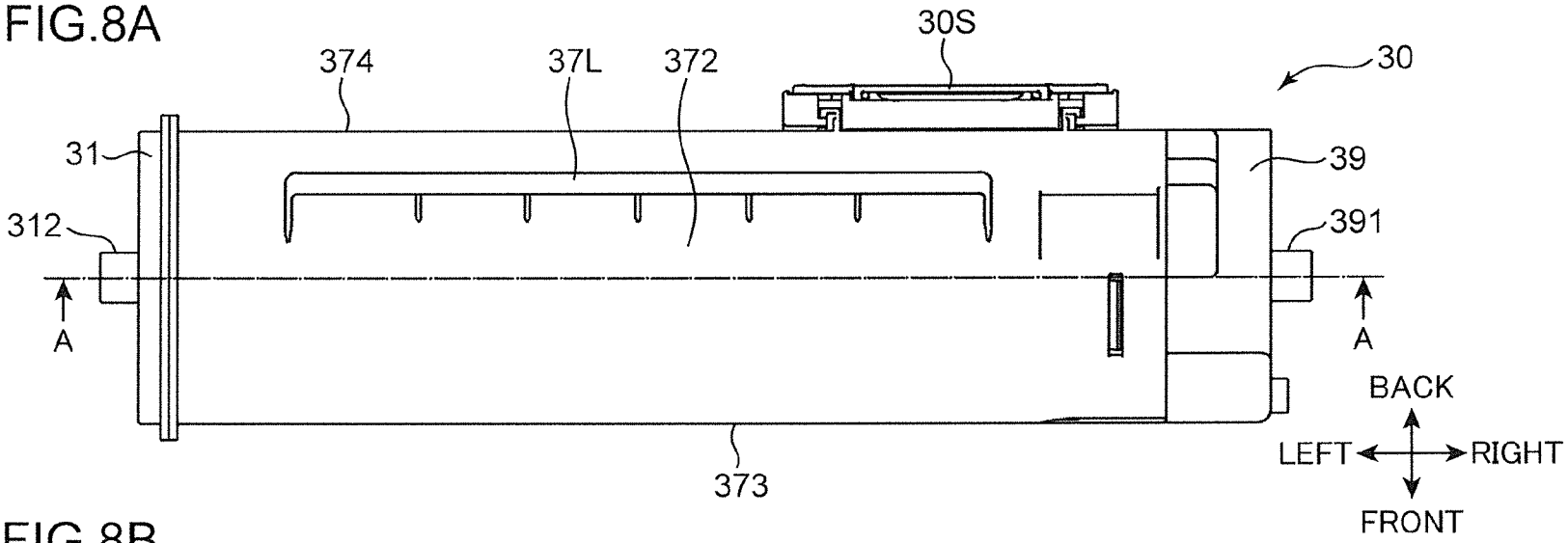
FIG. 8A is a plan view of the developer storage container according to the embodiment of the present invention.
Figure 8B:
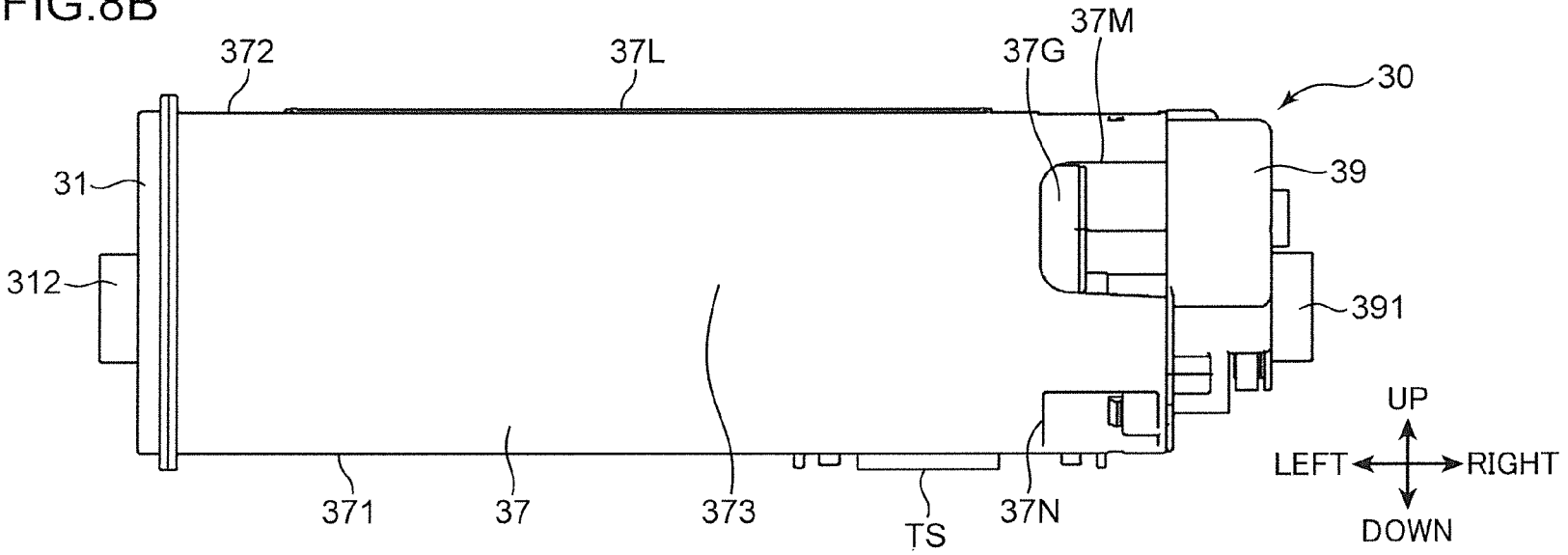
FIG. 8B is a front view of the developer storage container according to the embodiment of the present invention.
Figure 9:
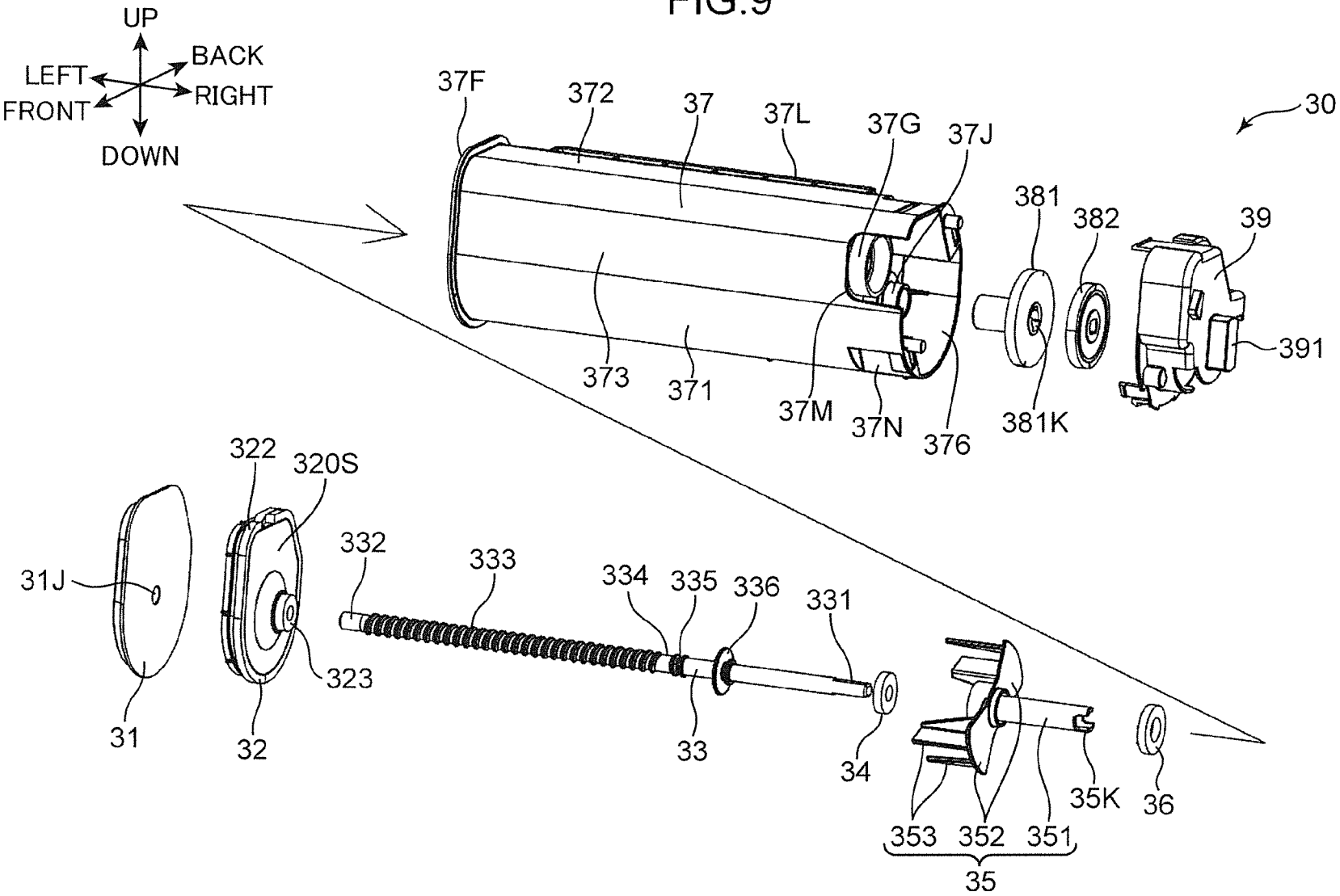
FIG. 9 is an exploded perspective view of the developer storage container according to the embodiment of the present invention.
Figure 10:
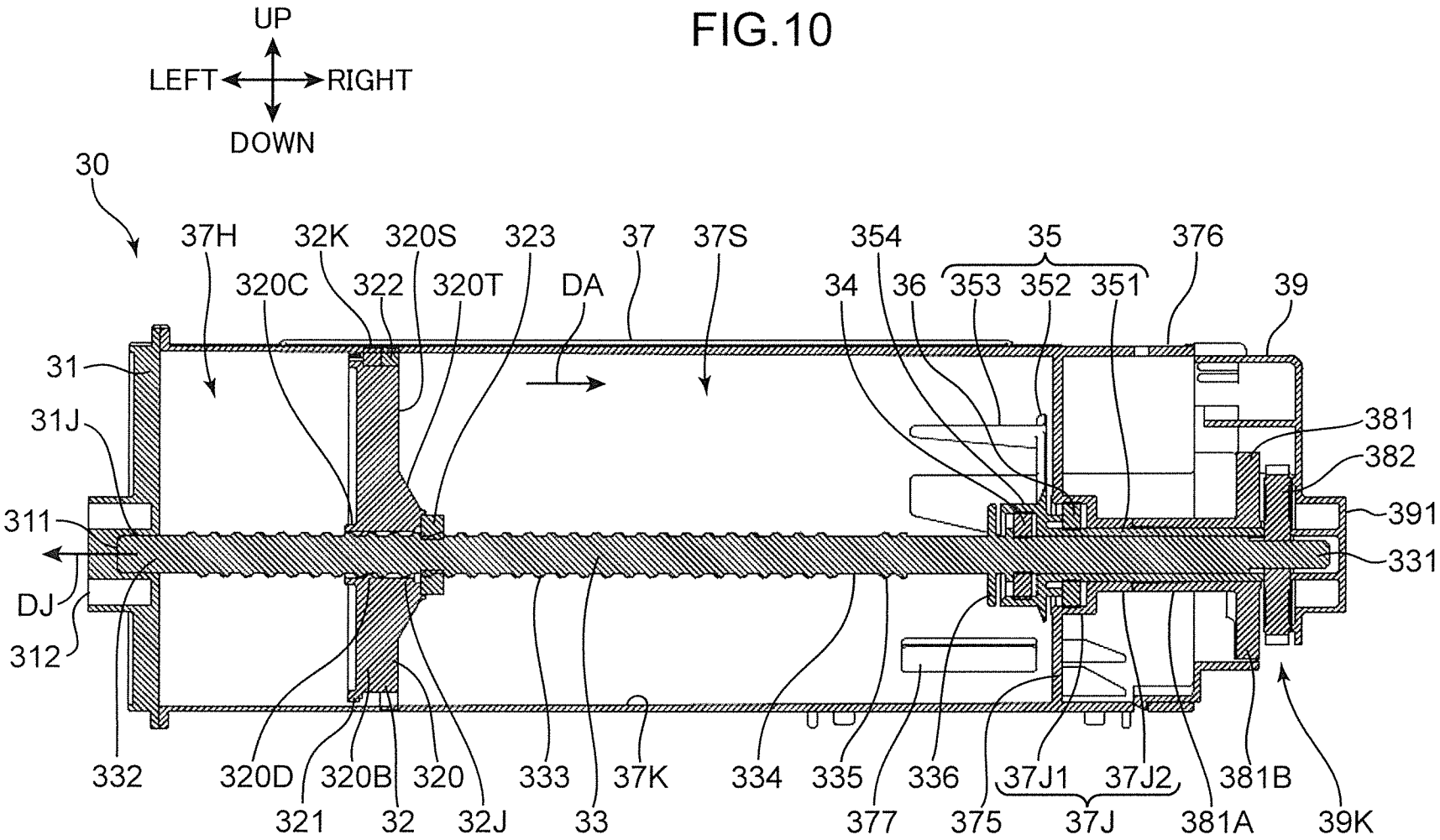
FIG. 10 is a sectional view of the developer storage container according to the embodiment of the present invention.
Figure 11:
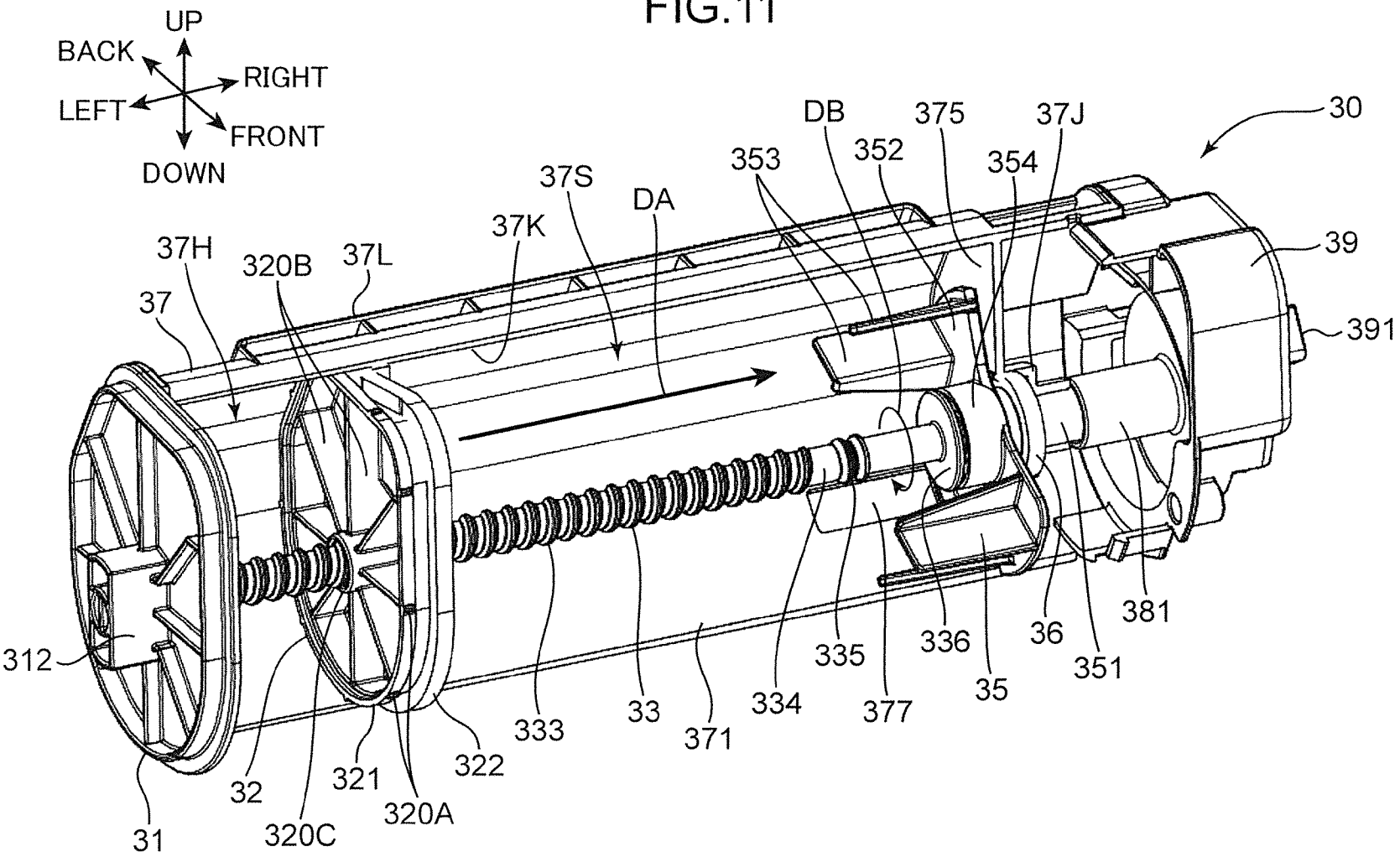
FIG. 11 is a perspective view showing a state inside the developer storage container according to the embodiment of the present invention.
Figure 12:
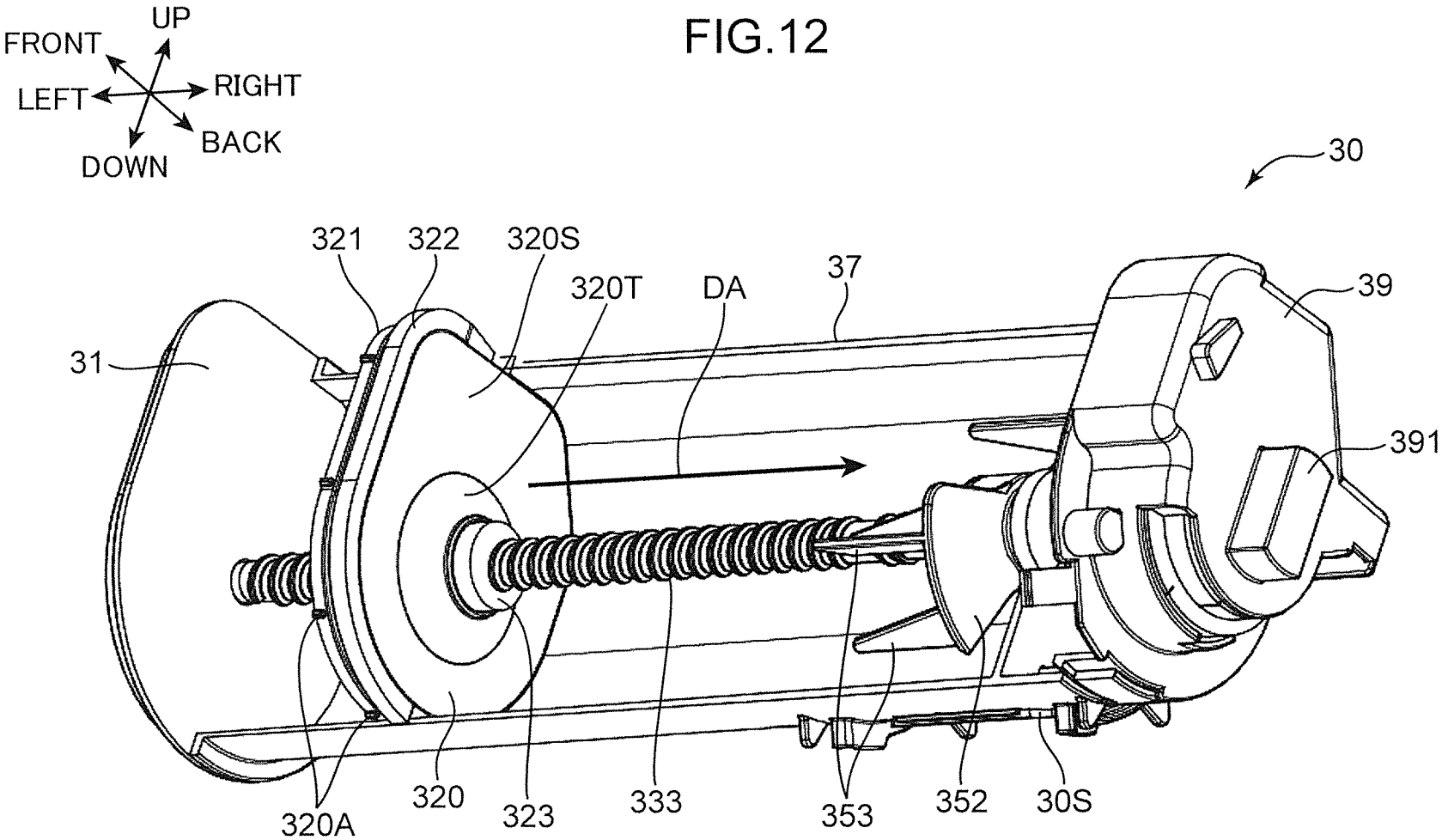
FIG. 12 is a perspective view showing a state inside the developer storage container according to the embodiment of the present invention.
Figure 13A:
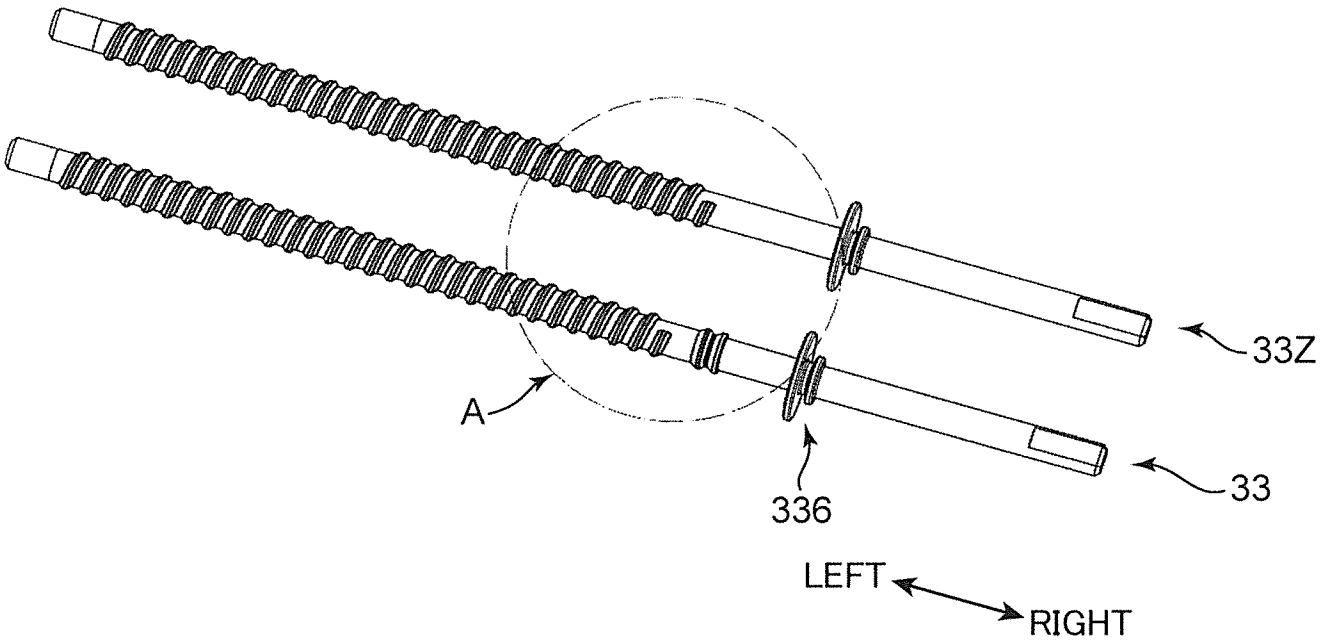
FIG. 13A is a perspective view of a shaft portion of the developer storage container according to the embodiment of the present invention.
Figure 13B:
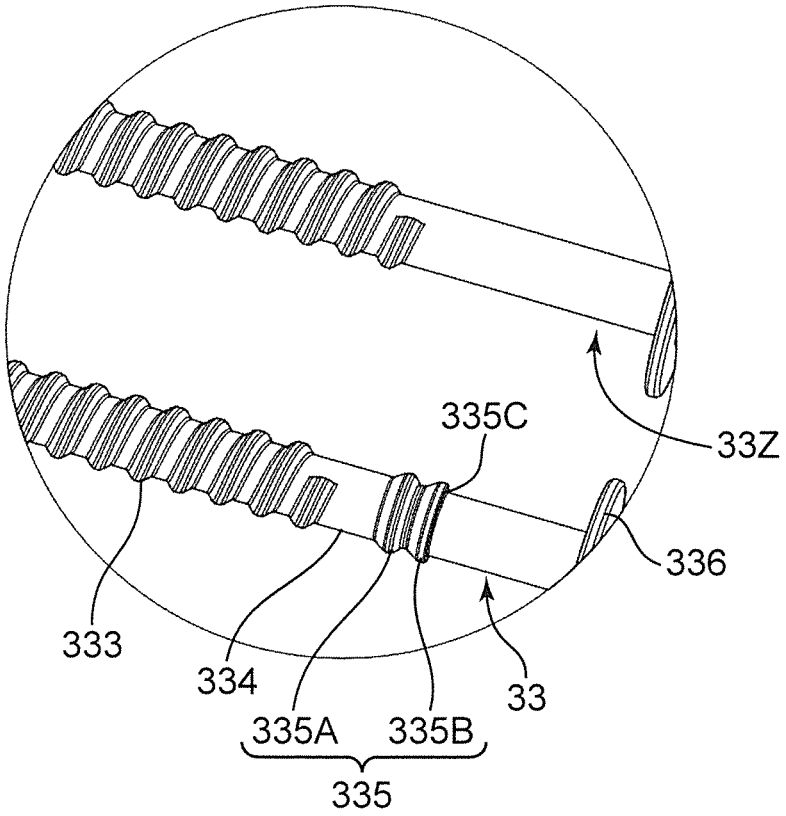
FIG. 13B is an enlarged perspective view enlargedly showing a part of the shaft portion of FIG. 13A.
Figure 14:
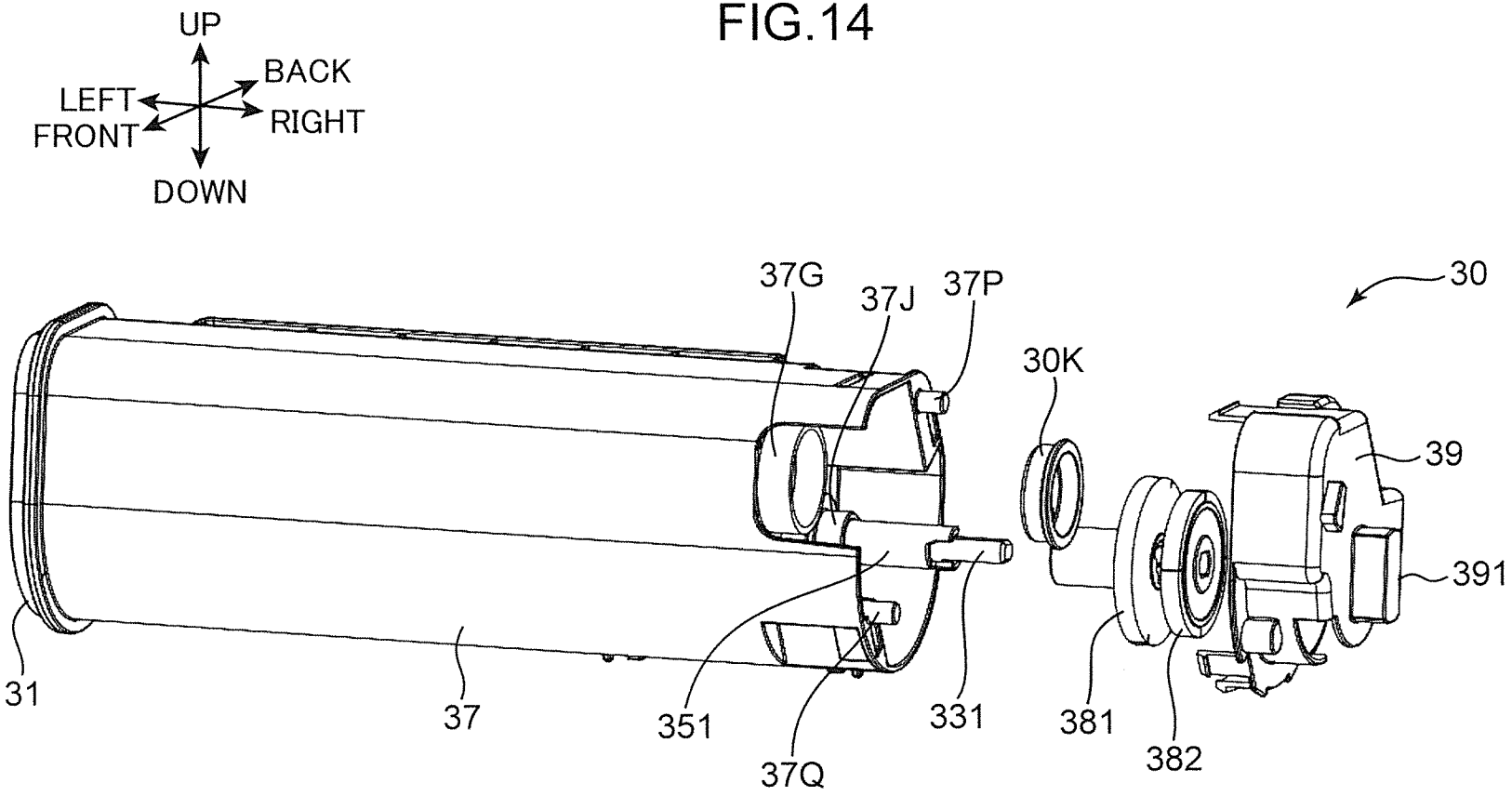
FIG. 14 is an exploded perspective view of the developer storage container according to the embodiment of the present invention.
Figure 15B:
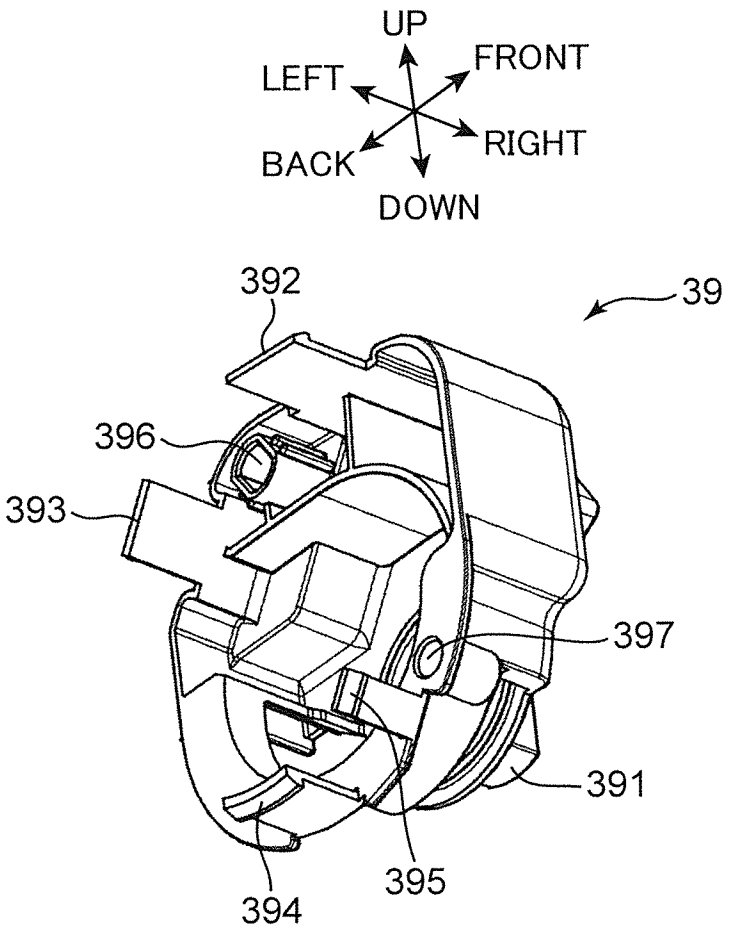
FIG. 15B is a perspective view of the cover member of the developer storage container according to the embodiment of the present invention.
Figure 15A:
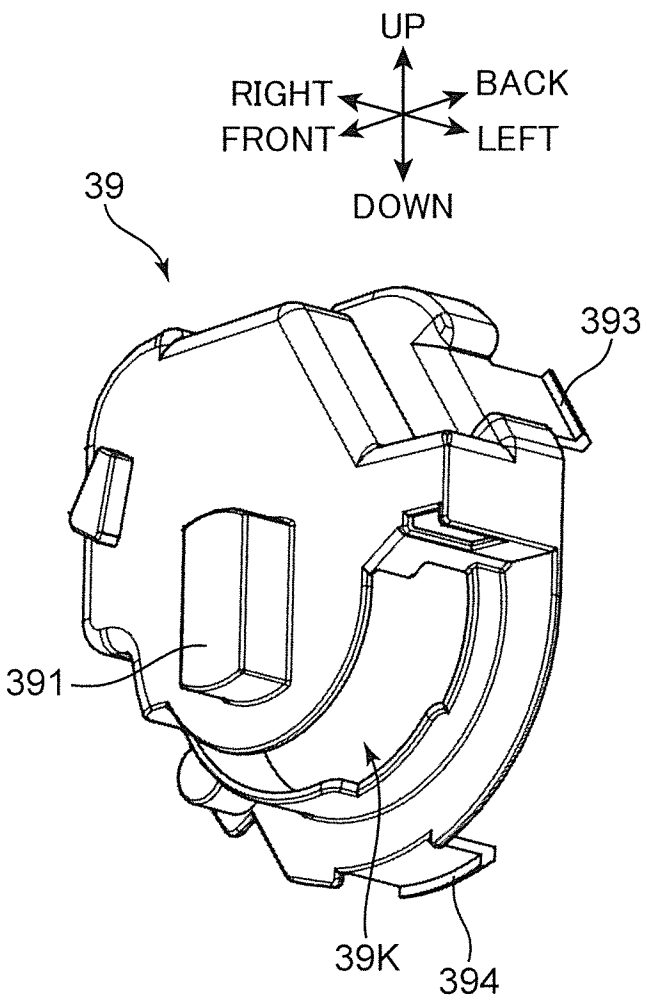
FIG. 15A is a perspective view of a cover member of the developer storage container according to the embodiment of the present invention.
Figure 16A:
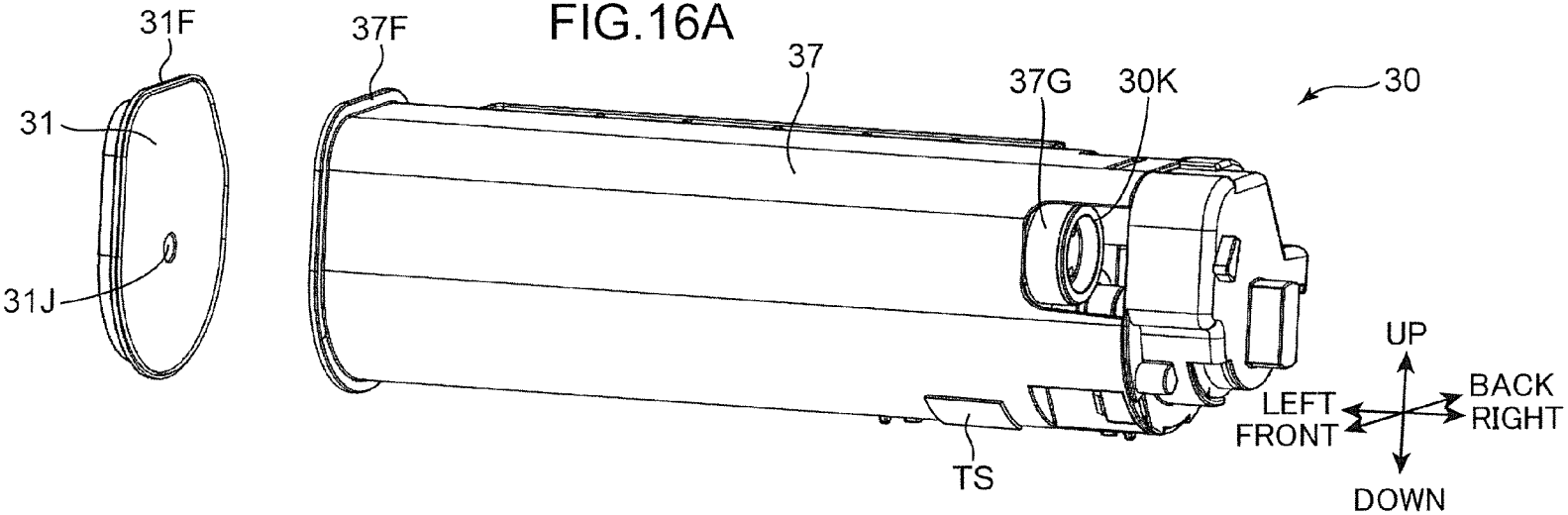
FIG. 16A is an exploded perspective view of the developer storage container according to the embodiment of the present invention.
Figure 16B:
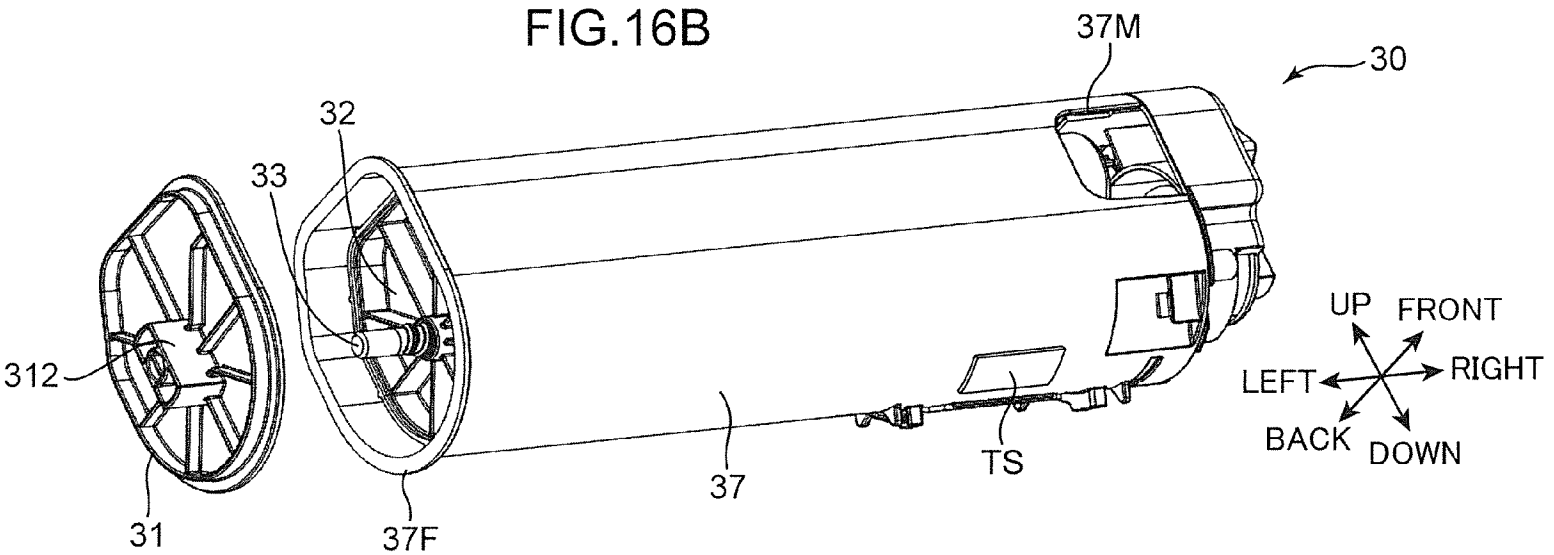
FIG. 16B is an exploded perspective view of the developer storage container according to the embodiment of the present invention.

Next, the toner container 30 (developer storage container) according to one embodiment of the present invention will be described with reference to FIGS. 8A to 12. FIG. 8A is a plan view of the toner container 30 according to the present embodiment, and FIG. 8B is a front view of the toner container 30. FIG. 9 is an exploded perspective view of the toner container 30. FIG. 10 is a sectional view of the toner container 30 and corresponds to a cross-section at position A-A of FIG. 8A. FIGS. 11 and 12 are perspective views showing a state inside the toner container 30 according to the present embodiment. It should be noted that FIGS. 11 and 12 are perspective views in which a later-described container body 37 of the toner container 30 is partly missing. FIG. 13A is a perspective view of the shaft portion 33 in the toner container 30. FIG. 13B is an enlarged perspective view enlargedly showing an area A of FIG. 13A. FIG. 14 is an exploded perspective view of the toner container 30. Further, FIGS. 15A and 15 are perspective views of the cover 39 of the toner container 30. Furthermore, FIGS. 16A and 16B are exploded perspective views of the toner container 30.

The toner container 30 is in the form of a cylinder extending in the lateral direction (first direction, direction of an arrow DA of FIG. 10). The toner container 30 contains replenishment toner (developer) inside. With reference to FIG. 9, the toner container 30 includes the lid 31 (facing wall portion), the movable wall 32, the shaft 33 (shaft portion), a first seal 34, the stirring member 35, a second seal 36, the container body 37 (container body), a filling port cap 30K (FIG. 14), a toner sensor TS (FIG. 16B), a first gear (FIG. 9), a second gear 382 (drive transmitting portion) and the cover 39.

The lid 31 (FIGS. 9, 10) is secured to the container body 37 to seal an opening of the container body 37. The lid 31 includes a lid shaft hole 31J, a contact portion 311 and a first guide portion 312. The lid shaft hole 31J is provided in a central part of the lid 31 and rotatably supports the shaft 33. The lid shaft hole 31J is a hole formed to have a predetermined length in a leftward direction from the right side surface (inner surface portion) of the lid 31. The contact portion 311 corresponds to a bottom surface portion of the lid shaft hole 31J. An end surface of the shaft 33 is in contact with the contact portion 311. The contact portion 311 functions to restrict the position of the shaft 33 in the first direction. The first guide portion 312 (FIG. 11) is a projection formed to extend in the vertical direction on the left side surface (outer surface portion) of the lid 31. The first guide portion 312 functions to guide the attachment of the toner container 30 to the developing device 20.

The container body 37 is a body part of the tubular toner container 30. The container body 37 includes an inner circumferential portion 37K and an internal space 37 (FIGS. 10, 11). The inner circumferential portion 37K is the inner circumferential surface of the container body 37 and defines the tubular internal space 37H extending along a longitudinal direction (first direction, direction of the arrow DA of FIGS. 10 and 11) of the toner container 30.

Further, with reference to FIGS. 8A and 8B, the container body 37 includes the bottom portion 371, a top plate 372, a front wall 373, a rear wall 374, a right wall 375 (wall portion) (FIG. 10), a body flange portion 37F (FIG. 9) and a projecting wall 376 (FIGS. 9, 10). The bottom portion 371 is a bottom part of the container body 37 and has a semi-cylindrical shape projecting downward. In other words, the bottom portion 371 has an arcuate shape in a cross-sectional view intersecting with the first direction. The front wall 373 and the rear wall 374 are a pair of side walls standing upward from side ends of the bottom portion 371. The top plate 372 is arranged above the bottom portion 371 and covers the internal space 37H from above. The right wall 375 is a wall portion connected to ends (right ends) of the bottom portion 371, the front wall 373, the rear wall 374 and the top plate 372 on one side in the first direction and closing the container body 37. It should be noted that the internal space 37H is a space defined by the inner circumferential portion 37K formed by the bottom portion 371, the top plate 372, the front wall 373 and the rear wall 374 and further by the right wall 375 and the lid 31. At this time, the right wall 375 defines one end surface of the internal space 37H in the first direction. Further, an area of the internal space 37H between the right wall 375 and the movable wall 32 serves as a container space 37S. The container space 37S is a space for containing toner in the toner container 30.

As shown in FIG. 10, an opposite side of the right wall 375 in the first direction out of the container body 37 is opened. The body flange portion 37F is an area forming this opening and slightly enlarging an outer diameter of a left end portion of the container body 37. When being fixed to the body flange portion 37F, the lid 31 closes the internal space 37H of the container body 37. It should be noted that a lid welding portion 31F (FIG. 16A), which is the outer circumferential edge of the lid 31, is ultrasonically welded (welded) to the body flange portion 37F.

With reference to FIGS. 9 and 10, the projecting wall 376 is a part of the outer circumferential part of the container body 31 projecting further rightward than the right wall 375. The cover 39 is mounted on the projecting wall 376.

Further, the container body 37 includes the toner discharge port 377 (developer discharge port), a shutter 30S, a grip portion 37L, a front cut portion 37M, a lower cut portion 37N, a filling port 37G and a body bearing portion 37J.

The toner discharge port 377 is an opening communicating with the internal space 37H and opened in a lower surface portion of the container body 37. As shown in FIGS. 10 and 11, the toner discharge port 377 is opened in a right end portion (one end portion in the first direction) of the container body 37. In other words, the toner discharge port 377 is arranged adjacent to the right wall 375 in the first direction.

Further, the toner discharge port 377 is a rectangular opening having a predetermined length along the first direction and a predetermined width along the arcuate shape of the bottom portion 371. In the present embodiment, the toner discharge port 377 is opened at a position displaced backward along a circumferential direction from a lower end portion of the bottom portion 371.

The toner contained in the container space 37S is discharged toward the developing device 20 through the toner discharge port 377. In the present embodiment, the internal space 37H of the container body 37 is formed by the bottom portion 371, the front wall 373, the rear wall 374 and the top plate 372 as described above. Thus, the toner in the container space 37S is accumulated in the arcuate bottom portion 371 by the dead weight of the toner, wherefore the toner conveyed by the movable wall 32 to be described later can be efficiently discharged through the toner discharge port 377.

The shutter 30S (FIG. 6) is slidably disposed on a right end portion of the container body 37. The shutter 30S closes (seals) the toner discharge port 377 from the outside of the container body 32 and exposes the toner discharge port 377 to outside. A sliding movement of the shutter 30S is interlocked with the attachment of the toner container 30 to the developing device 20.

The grip portion 37L (FIG. 9) is a projection laterally projecting in a rear part of the top plate 372 of the container body 32. The grip portion 37L is gripped by a user. The front cut portion 37M is an area formed by cutting a part of a front side of the side surface of the projecting wall 376 to the left. The front cut portion 37M exposes the filling port 37G. Further, the lower cut portion 37N is an area formed by recessing a part of a lower side surface of the projecting wall 376 radially inwardly. A fourth projecting piece 395 (FIG. 15B) of the cover 39 to be described later is engaged with the lower cut portion 37N.

The filling port 37G has a hollow cylindrical shape projecting rightward from the right wall 375. The hollow cylindrical interior of the filling port 37G is formed to penetrate through the right wall 375 in the first direction. The filling port 37G allows communication between the outside of the container body 37 and the container space 37S. In the manufacturing stage of the toner container 30, toner is filled into the container space 37S through the filling port 37G.

The body bearing portion 37J is a bearing formed on the right wall 375. The body bearing portion 37J has a hollow cylindrical shape projecting rightward from a central part of the right wall 375. With reference to FIG. 10, the body bearing portion 37J includes a large-diameter portion 37J1 and a small-diameter portion 37J2. The large-diameter portion 37J1 is a hollow cylindrical portion projecting rightward from the right wall 375. The small-diameter portion 37J2 is a hollow cylindrical portion coupled to a right end portion of the large-diameter portion 37J1 and having a smaller diameter than the large-diameter portion 37J1. The shaft 33 is passed through the body bearing portion 37J. At this time, a right end side of the shaft 33 projects to the outside of the container body 37. Further, a part (stirring bearing portion 351) of the stirring member 35 is passed between the body bearing portion 37J and the shaft 33 in the hollow cylindrical interior of the body bearing portion 37J.

The filling port cap 30K (FIG. 14) is attached to the filling port 37G of the container body 37 to seal the filling port 37G. After the toner is filled into the container space 37S through the filling port 37G, the filling port cap 30K is attached to the filling port 37G and welded. As a result, the leakage of the toner through the filling port 37G is prevented.

The movable wall 32 is a wall portion arranged to face in the first direction in the container body 37 (container space 37H). The movable wall 32 defines one end surface (left end surface) of the container space 37S in the first direction. It should be noted that the other end surface (right end surface) of the container space 37S in the first direction is defined by the right wall 375. Further, the movable wall 32 has a function of moving in the first direction in the internal space 37H from an initial position on one end side to a final position on the other end side in the first direction while conveying the toner contained in the container space 37S toward the toner discharge port 377 during a time from the start to the end of use of the toner container 30. In the present embodiment, the initial position of the movable wall 32 is arranged to the right of the lid 31 (downstream side in the first direction) and the final position is arranged immediately to the left of the toner discharge port 377 (upstream side in the first direction). Further, the movable wall 32 is moved by a rotational drive force generated by the first motor M1. It should be noted that the lid 31 is disposed upstream of the movable wall 32 in the first direction. Further, the right wall 375 is disposed downstream of the movable wall 32 in the first direction.

With reference to FIGS. 10 to 12, the movable wall 32 includes a conveying wall portion 320, an outer peripheral wall portion 321, guide ribs 320A (FIG. 12), inner ribs 320B (FIG. 11), a hollow cylindrical portion 320C, an inner wall seal 322 (seal member), a shaft seal 32 (cleaning member), a bearing portion 32J (FIG. 10) and an outer circumferential portion 32K.

The conveying wall portion 320 is a wall portion defining the container space 37S in cooperation with the inner circumferential portion 37K of the container body 37. Particularly, the conveying wall portion 320 has a conveying surface 320S perpendicular to the shaft 33. The conveying surface 320S conveys the toner in the container space 37S while pushing the toner according to a movement of the movable wall 32. In the present embodiment, the conveying surface 320S has a tapered surface 320T (FIGS. 10, 12). The tapered surface 320T is formed to incline a part of the conveying surface 32S toward a downstream side in the first direction so as to surround around the shaft 33.

The bearing portion 32J is a bearing portion formed substantially in a central part of the conveying wall portion 320. The bearing portion 32J moves along the first direction while holding the movable wall 32. The shaft 33 to be described later is passed through this bearing portion 32J.

The hollow cylindrical portion 320C is a hollow cylindrical part projecting toward the upstream side in the first direction from a surface of the conveying wall portion 320 opposite to the conveying surface 320S. The hollow cylindrical portion 320C forms a part of the bearing portion 32J. The hollow cylindrical portion 320C includes an internal thread portion 320D (second engaging portion). The internal thread portion 320D is a spiral screw portion projecting from the inner circumferential surface of the hollow cylindrical portion 320C. The internal thread portion 320D has a function of moving the movable wall 32 in the first direction by being engaged with a later-described external thread portion 333 of the shaft 33. At this time, the posture of the movable wall 32 is maintained by the contact of the inner wall of the hollow cylindrical portion 320C and the outer periphery of the shaft 33. This reduces the inclination of the conveying wall portion 320 of the movable wall 32 with respect to the shaft 33.

The outer peripheral wall portion 321 is a wall portion projecting from the entire outer circumferential edge of the conveying wall portion 320 toward a side opposite to the container space 37S, i.e. toward an upstream side in a moving direction of the movable wall 32 (upstream side in the first direction). The outer peripheral wall portion 321 is disposed to face the inner circumferential portion 37K of the container body 32. The guide rib 320A is a rib member extending along the first direction on the outer peripheral wall portion 321. A plurality of the guide ribs 320A are arranged at intervals in a circumferential direction of the rotation of the shaft 33 on the circumferential surface of the outer peripheral wall portion 321. The guide ribs 320A have a function of reducing the inclination of the movable wall 32 with respect to the shaft 33 in the container body 37 by slightly contacting the inner circumferential portion 37K of the container body 37.

As shown in FIG. 11, the inner rib 320B is a rib coupling the outer circumferential surface of the hollow cylindrical portion 320C and the inner circumferential surface of the outer peripheral wall portion 321. A plurality of the inner ribs 320B are arranged along the circumferential direction. It should be noted that, since a sectional view of FIG. 10 is a vertical sectional view passing through an axial center of the shaft 33, some of the inner ribs 320B and the conveying wall portion 320 are shown to be connected.

The inner wall seal 322 is a seal member disposed to cover around the conveying wall portion 320 on the side of the outer peripheral wall portion 321 near the conveying wall portion 320. The inner wall seal 322 is an elastic member made of urethane sponge. After one end of the tape-like inner wall seal 322 is fixed to an upper part of the conveying wall portion 320, the inner wall seal 322 is fixed while being wound around the conveying wall portion 320. Then, the other end of the inner wall seal 322 is fixed to be placed on the one end of the inner wall seal 322. The inner wall seal 322 is compressively deformed between the inner circumferential portion 37K of the container body 37 and the movable wall 32. Further, the inner wall seal 322 forms the outer circumferential portion 32K of the movable wall 32. The outer circumferential portion 32K is slidably disposed in close contact with the inner circumferential portion 37K of the container body 37. The inner wall seal 322 prevents the outflow of the toner in the container space 37S 2 to a side upstream of the movable wall 32 in the moving direction through a clearance between the inner circumferential portion 37K of the container body 37 and the movable wall 32. It should be noted that the aforementioned guide ribs 320A are disposed upstream of the inner wall seal 322 in the first direction.

The shaft seal 323 is fixed to a tip side of the bearing portion 32J more forward than the internal thread portion 320D in the moving direction of the movable wall 32 (FIG. 11). Particularly, in the present embodiment, the shaft seal 323 is disposed on a tip portion of the tapered surface 320T of the conveying surface 320S. The shaft seal 323 is an elastic member made of urethane sponge. The shaft seal 323 contacts the external thread portion 333 of the shaft 33 according to a movement of the movable wall 32. At this time, the shaft seal 323 contacts the external thread portion 333 earlier than the internal thread portion 320D to clean the toner adhering to the external thread portion 333. Accordingly, the external thread portion 333 is engaged with the internal thread portion 320D with the toner substantially removed from the external thread portion 333. This reduces the aggregation of the toner between the external thread portion 333 and the internal thread portion 320D to stably realize a movement of the movable wall 32. Further, since having a ring shape, the shaft seal 323 is held in close contact with the shaft 33 over the entire circumference of the shaft 33. This prevents the toner in the container space 37S from flowing out to a more upstream side than the movable wall 32 in the moving direction through the bearing portion 32J.

The shaft 33 is rotatably supported on the right wall 375 of the container body 37 and the lid 31 to extend in the first direction in the internal space 37H. The shaft 33 includes a first shaft end portion 331, a second shaft end portion 332, the external thread portion 333 (first engaging portion), a movable wall stopping portion 334, movable wall supporting portions 335 and shaft flanges 336.

With reference to FIGS. 9 and 10, the first shaft end portion 331 is a right end portion (one end portion in the first direction) of the shaft 33. The first shaft end portion 331 is a tip portion of the shaft 33 projecting to the right through the body bearing portion 37J. As shown in FIG. 9, a pair of D-surfaces are formed on the circumferential surface of the first shaft end portion 331. A second gear 382 having a D-shaped hole in a central part is engaged with the first shaft end portion 331. As a result, the shaft 33 and the second gear 32 are made integrally rotatable. Further, the tip portion of the first shaft end portion 331 penetrating through the second gear 382 is disposed to enter the interior of a later-described second guide portion 391 of the cover 39. The second shaft end portion 332 is a left end portion (other end portion in the first direction) of the shaft 33. The second shaft end portion 332 is rotatably supported in the lid bearing hole 31J formed in the lid 31.

The external thread portion 333 is a spiral screw portion projecting along the first direction on the outer circumferential surface of the shaft 33 in the internal space 37H. In the present embodiment, the external thread portion 333 is disposed from an area of the shaft 33 adjacent to the lid 31 to an area upstream of the toner discharge port 377 in the first direction (arrow DA of FIG. 10).

The movable wall supporting portion 334 is disposed to be continuous with a downstream side of the external thread portion 33 in the first direction. The movable wall supporting portion 334 is an area of the shaft 33 in the internal space 37H constituted only by a shaft part, the external thread portion 333 partially missing on the movable wall supporting portion 334. The movable wall supporting portion 334 is located above the toner discharge port 377 and upstream of the toner discharge port 377 in the first direction.

The movable wall supporting portions 335 are disposed downstream of the movable wall supporting portion 334 in the first direction. In other words, the external thread portion 333 and the movable wall supporting portions 335 are not continuous in the first direction. The movable wall supporting portions 335 are projections radially projecting from the circumferential surface of the shaft 33. As shown in FIG. 10, the movable wall supporting portions 335 are disposed above an upstream end portion of the toner discharge port 377 in the first direction. A perspective view and an enlarged perspective view of the shaft 33 and a shaft 33Z are shown in FIG. 13B. It should be noted that the shaft 33Z is described in a modification later and includes no movable wall supporting portion 335 as compared to the shaft 33 in the present embodiment.

The movable wall supporting portion 335 has a function of suppressing the inclination of the conveying surface 320S of the movable wall 32 with respect to the first direction (inclination with respect to the shaft 33) when the movable wall 32 reaches the final position. The movable wall supporting portion 335 is disposed along the circumferential direction on the circumferential surface of the shaft 33 and has a ring shape. It should be noted that, in the present embodiment, a plurality of (two) the movable wall supporting portions 335 are disposed along the first direction. Specifically, the movable wall supporting portions 335 include a first supporting portion 335A and a second supporting portion 335B (FIG. 13B). The first supporting portion 335A is a ring-shaped projection disposed on an upstream side in the first direction. The second supporting portion 335B is a ring-shaped projection disposed on a downstream side in the first direction. As shown in an enlarged view of FIG. 13B, the first supporting portion 335A has oblique surfaces sloping downward toward the upstream and downward sides in the first direction with a ridge arranged substantially in a central part in the first direction acting as a center. On the other hand, the second supporting portion 335B has an oblique surface sloping upward toward the downstream side in the first direction and a side end surface 335C coupled to this oblique surface. The side end surface 335C is disposed to face in the first direction and be perpendicular to the first direction.

It should be noted that the height of the first and second supporting portions 335A, 335B from the circumferential surface of the shaft 33 may be set equal to or slightly larger than that of the ridge of the external thread portion 333.

The shaft flange 336 is disposed downstream of the movable wall supporting portions 335 in the first direction while being at a distance from the movable wall supporting portions 335. The shaft flange 336 is a disk-like flange radially projecting from the circumferential surface of the shaft 33. It should be noted that two shaft flanges 336 are disposed adjacent to each other in the first direction as shown in FIGS. 9, 10 and 13A. The shaft flange 336 on the downstream side in the first direction has a smaller diameter than the shaft flange 336 on the upstream side in the first direction. This shaft flange 336 on the downstream side has a function of compressing the first seal 34 (FIG. 10) in cooperation with a later-described stirring hollow cylindrical portion 354 (FIG. 11) of the stirring member 35. On the other hand, the shaft flange 336 on the upstream side has a function of reducing the entrance of the toner into the stirring hollow cylindrical portion 354.

The first seal 34 is a ring-shaped seal member compressively disposed between the shaft flanges 336 of the shaft 33 and the stirring hollow cylindrical portion 354 of the stirring member 35. The first seal 34 is made of a sponge material. The first seal 34 prevents the toner from leaking to the outside of the container body 37 through a clearance between the inner circumferential surface of the stirring bearing portion 351 (FIG. 10) of the stirring member 35 and the circumferential surface of the shaft 33.

The stirring member 35 (FIGS. 9, 10) is disposed along the right wall 375 above the toner discharge port 377. The stirring member 35 stirs the toner in the container space 37S around the toner discharge port 377. In the present embodiment, the stirring member 35 rotates about an axis of the shaft 33 and relative to the shaft 33. In FIG. 11, the stirring member 35 is rotated in a direction of an arrow DB. The stirring member 35 includes the stirring bearing portion 351, stirring supporting portions 352 (supporting portion), stirring blades 353 (blade portion) and the stirring hollow cylindrical portion 354 (FIGS. 10, 11).

The stirring bearing portion 351 is externally fitted to the shaft 33 and has a hollow cylindrical shape. The stirring bearing portion 351 is passed through the body bearing portion 37J from the side of the container space 37S of the container body 37. As a result, a right end side of the stirring bearing portion 351 penetrates through the body bearing portion 37J and is exposed to the outside of the container body 37 from the right wall 375 (body bearing portion 37J) (see FIG. 14). On the other hand, a left end side of the stirring bearing portion 351 is disposed in the container space 37S. A first engaging portion 35K is formed on a right end portion of the stirring bearing portion 351 (FIG. 9). The first engaging portion 35K is engaged with a second engaging portion 381K formed on the inner circumferential surface of a first gear 381. As a result, the stirring member 35 and the first gear 381 integrally rotate.

The stirring supporting portion 352 is a projecting piece projecting in a radial direction of the rotation of the shaft 33 from the left end side of the hollow cylindrical stirring bearing portion 351. The stirring supporting portion 352 is disposed to face in the first direction (intersect with the first direction) along the right wall 375. The stirring supporting portion 352 rotates about the axis of the shaft 33 in the container space 37S. Particularly, a pair of the stirring supporting portions 352 are disposed in the present embodiment. Specifically, one stirring supporting portion 352 is disposed to extend radially outward from the shaft 33 along the right wall 375. Further, the other stirring supporting portion 352 is disposed to extend radially outward at a position different from the one stirring supporting portion 352 in the circumferential direction. In other words, the pair of stirring supporting portions 352 are disposed to extend toward sides radially opposite to each other and have a propeller blade shape set to be wider in the circumferential direction toward radially outer sides. Thus, as compared to the case where the stirring supporting portions 352 are disk-shaped, the toner in a clearance between the stirring supporting portions 352 and the right wall 375 easily moves, thereby preventing the aggregation of the toner.

The stirring blades 353 are blade members projecting leftward (upstream side in the first direction) from the pair of stirring supporting portions 352. As shown in FIGS. 11 and 12, two stirring blades 353 project from each stirring supporting portion 352. The stirring blade 353 is L-shaped in a cross-sectional view perpendicular to an axial direction of the shaft 33 (see FIG. 17B). The stirring blades 353 stir the toner around the toner discharge port 377 and discharges the toner through the toner discharge port 377 while turning above the toner discharge port 377.

The stirring hollow cylindrical portion 354 is an area of the stirring bearing portion 351 to the left of the stirring supporting portions 352. An outer diameter of the stirring hollow cylindrical portion 354 is set larger than that of the stirring bearing portion 352 to the right of the stirring supporting portions 352. As shown in FIG. 10, the first seal 34 is compressively disposed in the stirring hollow cylindrical portion 354.

The second seal 36 is a ring-shaped seal member disposed in the large-diameter portion 37J1 of the container body 37. The second seal 36 is compressively disposed between a step portion between the large-diameter portion 37J1 and the small-diameter portion 37J2 of the body bearing portion 37J and a ring-shaped projection formed on the right side surface of the stirring supporting portion 352. The second seal 36 is made of a sponge material. The second seal 36 prevents the toner from leaking to the outside of the container body 37 through a clearance between the outer circumferential surface of the stirring bearing portion 351 of the stirring member 35 and the inner circumferential surface of the bearing portion 37J.

The first gear 381 transmits a rotational drive force to the stirring member 35. The first gear 381 is coupled to the second motor M2 via the first and second transmission gears 211, 212 (FIG. 7). The first gear 381 is coupled to the stirring bearing portion 351 of the stirring member 35 penetrating through the body bearing portion 37. The first gear 381 includes a gear hollow cylindrical portion 381A having a hollow cylindrical shape and a first gear portion 381B (FIG. 10).

The gear hollow cylindrical portion 381A is a hollow cylindrical portion to be externally fitted to the stirring bearing portion 351 of the stirring member 35. Further, as described above, the first engaging portion 35K (FIG. 9) of the stirring member 35 is coupled to the second engaging portion 381K of the first gear 381, whereby the gear hollow cylindrical portion 381A is coupled to the stirring bearing portion 351. As a result, the first gear 381 and the stirring member 35 integrally rotate.

The first gear portion 381B is a gear disposed on a right end portion of the hollow cylindrical gear portion 381A. The first gear portion 381B has a larger outer diameter than the gear hollow cylindrical portion 381A. A plurality of gear teeth are provided on the circumferential surface of the first gear portion 381B.

The second gear 382 transmits a rotational drive force to the shaft 33. A plurality of gear teeth are provided also on the circumferential surface of the second gear 382. The second gear 382 is coupled to the first motor M1 via the third transmission gear 213 (FIG. 7). As shown in FIG. 10, the right end portion of the shaft 33 is disposed through the stirring bearing portion 351 of the stirring member 35. The second gear 382 is coupled (fixed) to the tip portion (first shaft end portion 331) of the shaft 33 passed through the stirring bearing portion 351. It should be noted that, as shown in FIG. 10, the side surface of the second gear 382 is facing the tip of the stirring bearing portion 351 of the stirring member 35. Further, the second gear 382 is disposed adjacent to the first gear portion 381B in the first direction. It should be noted that the first and second gears 381, 382 are disposed on a downstream side in the moving direction of the movable wall 32 (first direction).

In other words, as shown in FIG. 10, the first and second gears 381, 382 are disposed in a concentrated manner at a position facing the right wall 375 of the container body 37 outside the container body 37. Thus, the entire toner container 30 can be compactly configured particularly in the first direction. Further, the need to provide penetrating shaft holes in both the lid 31 and the right wall 375 is reduced. Thus, the leakage of the toner (developer) and a reduction in the rigidity of the lid 31 and the right wall 374 are suppressed. Further, in the present embodiment, the first and second gears 381, 382 are adjacently disposed by the shape of the first gear 381 including the hollow cylindrical gear portion 381A. Thus, a driving section (first, second and third transmission gears 211, 212 and 213) for inputting a drive force to the first and second gears 381, 382 can be disposed in a concentrated manner in the developing device 20.

The cover 39 is mounted on the projecting wall 376 of the container body 37. The cover 39 has a function of exposing circumferential parts of the first and second gears 381, 382 to outside and covering other circumferential parts of the first and second gears 381, 382. With reference to FIGS. 15A and 15B, the cover 39 includes a second guide portion 391, a first projecting piece 392, a second projecting piece 393, a third projecting piece 394, the fourth projecting piece 395, a first hole 396, a second hole 397 and a gear opening 39K.

The second guide portion 391 is a projecting portion extending along the vertical direction and projecting rightward on the right side surface of the cover 39. The second guide portion 391 has a function of guiding the attachment of the toner container 30 to the developing device 20 in cooperation with the first guide portion 312 of the lid 31. It should be noted that, as shown in FIG. 10, the tip portion of the first shaft end portion 331 penetrating through the second gear 382 is housed in the second guide portion 391.

The first, second, third and fourth projecting pieces 392, 393, 394 and 395 are projecting pieces projecting leftward from the outer circumferential edge of the cover 39. These projecting pieces are used as so-called snap-fits when the cover 39 is mounted on the container body 37. The first and second holes 396, 397 are holes opened near the outer circumferential edge of the left side surface of the cover 39. On the other hand, with reference to FIG. 14, the container body 37 further includes a first stud 37P and a second stud 37Q in the form of pins projecting rightward. When the cover 39 is mounted on the container body 37, the first and second studs 37P, 37Q are respectively inserted into the first and second holes 396, 397, whereby the position of the container body 39 in the circumferential direction is specified.

As shown in FIG. 15A, the gear opening 39K is an opening opened in a lower surface portion of the cover 39 and having an arcuate shape. When the cover 39 is mounted on the container body 37, some of the gear teeth of the first and second gears 381, 382 are exposed to the outside of the toner container 30 via the gear opening 39K. As a result, when the toner container 30 is mounted in the development housing 210 of the developing device 20, the first and second gears 381, 382 are respectively engaged with the second and third transmission gears 212, 213 (FIG. 7). By providing the gear opening 39K in this way, it is possible to input rotational drive forces to the first and second gears 381, 382 while protecting the first and second gears 381, 382.

The toner sensor TS (FIGS. 8B, 16B) is a sensor disposed on the bottom portion 371 of the container body 37. The toner sensor TS is disposed adjacent to the toner discharge port 377 in the circumferential direction and, in the present embodiment, fixed to a bottommost surface portion of the bottom portion 371. The toner sensor TS is a sensor formed of a magnetic permeability sensor or a piezoelectric element. If the toner sensor TS is formed of a piezoelectric element, a sensor part of the toner sensor TS is exposed to the container space 37S. The toner sensor TS outputs a HIGH-signal (+5 V) by being pressed by the toner in the container space 37S. Further, if there is almost no toner above the toner sensor TS, the toner sensor TS outputs a LOW-signal (0 V). An output signal of the toner sensor TS is referred to by the controller 50 (FIG. 7). It should be noted that, if the toner sensor TS is a magnetic permeability sensor, the sensor needs not directly contact the toner. Thus, in another embodiment, the toner sensor TS may be disposed on the side of the development housing 210 of the developing device 20 to face the outer wall of the container body 37. Further, the arrangement of the toner sensor TS is not limited to that on the bottom portion 371. In another embodiment, a toner sensor may be disposed on the top plate 372, the front wall 373, the rear wall 374 or the like of the container body 37.

<Concerning how to Assemble Toner Container>

Next, the summary of the assembling procedure of the toner container 30 is described. With reference to FIG. 9, the first seal 34 is fitted through the first shaft end portion 331 of the shaft 33. The first seal 34 comes into contact with the shaft flange 336. On the other hand, the second seal 36 is fitted on the stirring bearing portion 351 of the stirring member 35. The second seal 36 comes into contact with the ring-shaped projection disposed on base end portions of the stirring supporting portions 352. Further, the first shaft end portion 331 of the shaft 33 is passed through the stirring bearing portion 351 of the stirring member 35. Thereafter, the movable wall 32 is fitted on the second shaft end portion 332 of the shaft 33. The movable wall 32 is mounted on the shaft 33 while being rotated several turns to engage the internal thread portions 320D of the movable wall 32 and the external thread portion 333 of the shaft 33. The first shaft end portion 331 of the shaft 33 is inserted into the internal space 37H from the side of the body flange portion 37F of the container body 37 with the movable wall 32, the shaft 33, the first seal 34, the stirring member 35 and the second seal 36 integrated. The first shaft end portion 331 projects toward the right end side of the container body 37 as shown in FIG. 14 while penetrating through the body bearing portion 37J. Thereafter, with reference to FIG. 16A, the lid welding portion 31F of the lid 31 is ultrasonically welded to the body flange portion 37F of the container body 37. As a result, the internal space 37H and the container space 37S are formed in the container body 37. The toner is filled into the container space 37S with the filling port 37G of the container body 37 opened.

<Concerning Filling of Developer>

Figure 17A:
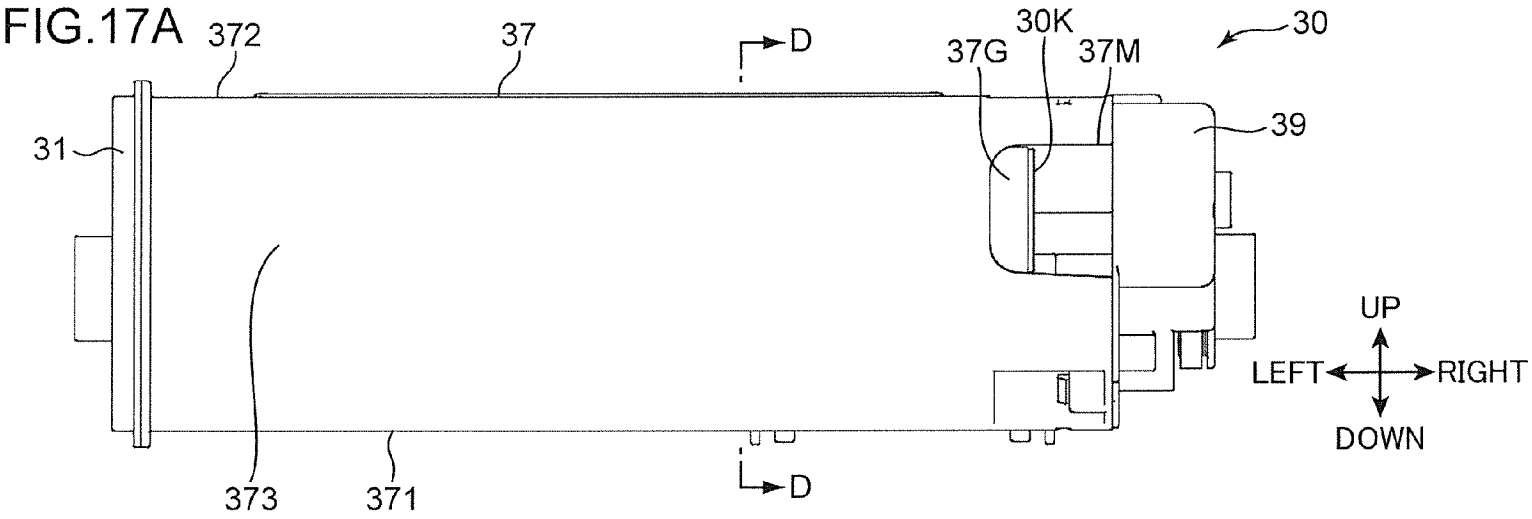
FIG. 17A is a front view of the developer storage container according to the embodiment of the present invention.
Figure 17B:
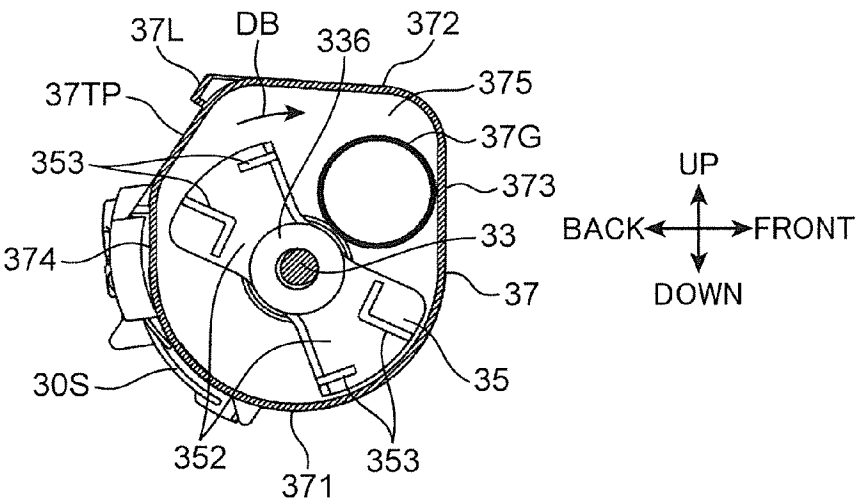
FIG. 17B is a sectional view of the developer storage container according to the embodiment of the present invention.
Figure 18A:
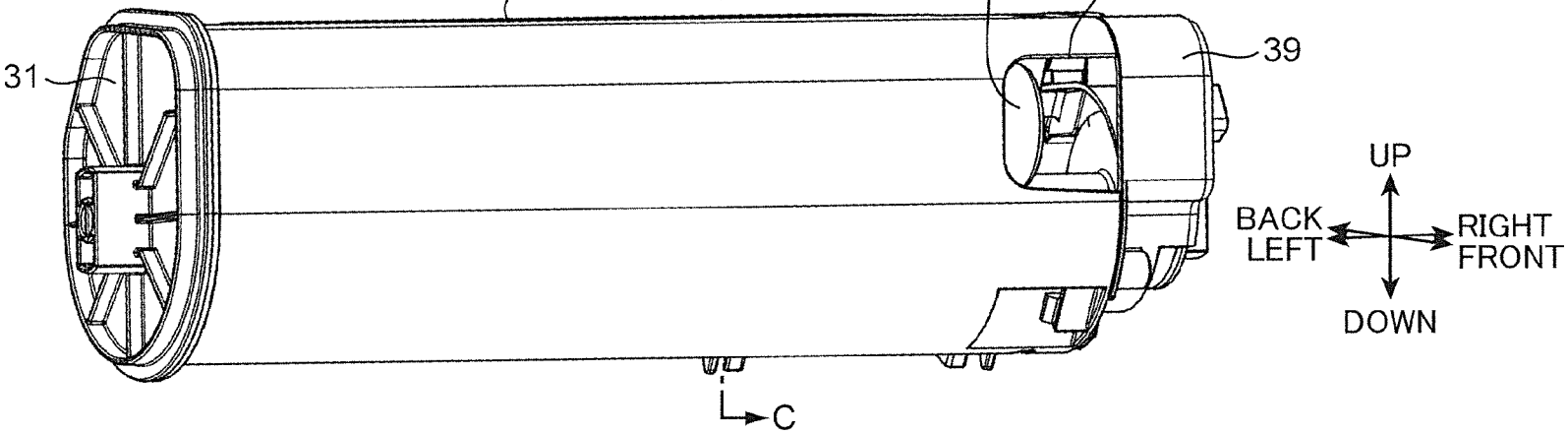
FIG. 18A is a perspective view of the developer storage container according to the embodiment of the present invention.
Figure 18B:
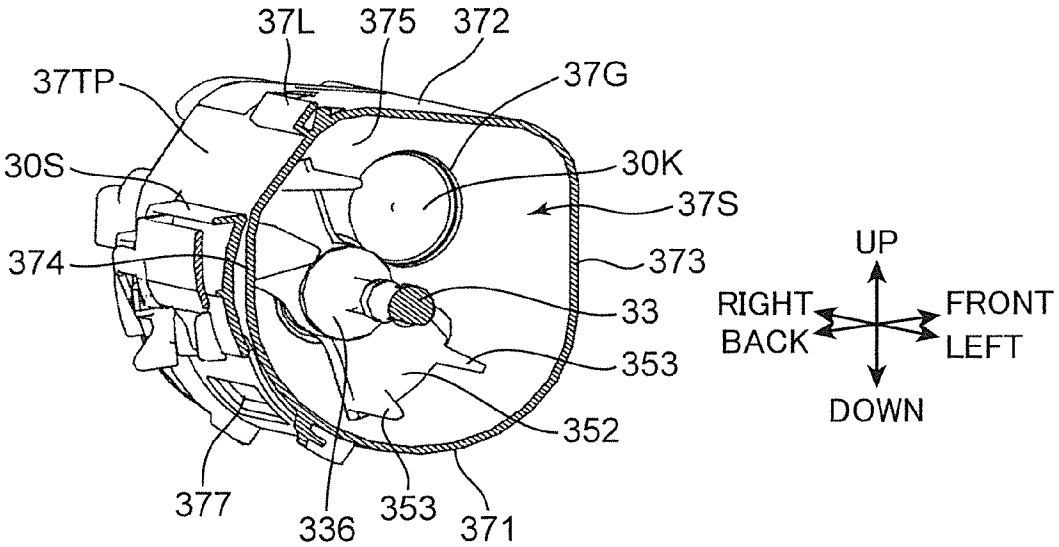
FIG. 18B is a perspective view in section of the developer storage container according to the embodiment of the present invention.

FIG. 17A is a front view of the toner container 30 according to the present embodiment, and FIG. 17B is a sectional view of the toner container 30. FIG. 17B is a sectional view at position D-D of FIG. 17A. FIG. 18A is a perspective view of the toner container 30, and FIG. 18B is a perspective view in section of the toner container 30. The perspective view in section of FIG. 18B includes a cross-section at position C-C of FIG. 18A.

With reference to FIGS. 17A, 17B and 18B, the stirring member 35 is shaped to expose the filling port 37G at a predetermined rotational position about the shaft 33 of the stirring member 35 when the right wall 375 is viewed from the upstream side in the first direction (left side, side to the front of the plane of FIG. 17B) in the present embodiment. Specifically, as shown in FIG. 17B, when the stirring member 35 is disposed at the predetermined rotational position about the shaft 33, the filling port 37G is exposed between one and the other stirring supporting portions 352 in the circumferential direction. Thus, even if the stirring member 35 is rotatable at a position along the right wall 375, the toner can be smoothly filled into the container space 37S via the filling port 37G by adjusting the rotational position of the stirring member 35 as shown in FIGS. 17B and 18B.

Figure 21A:
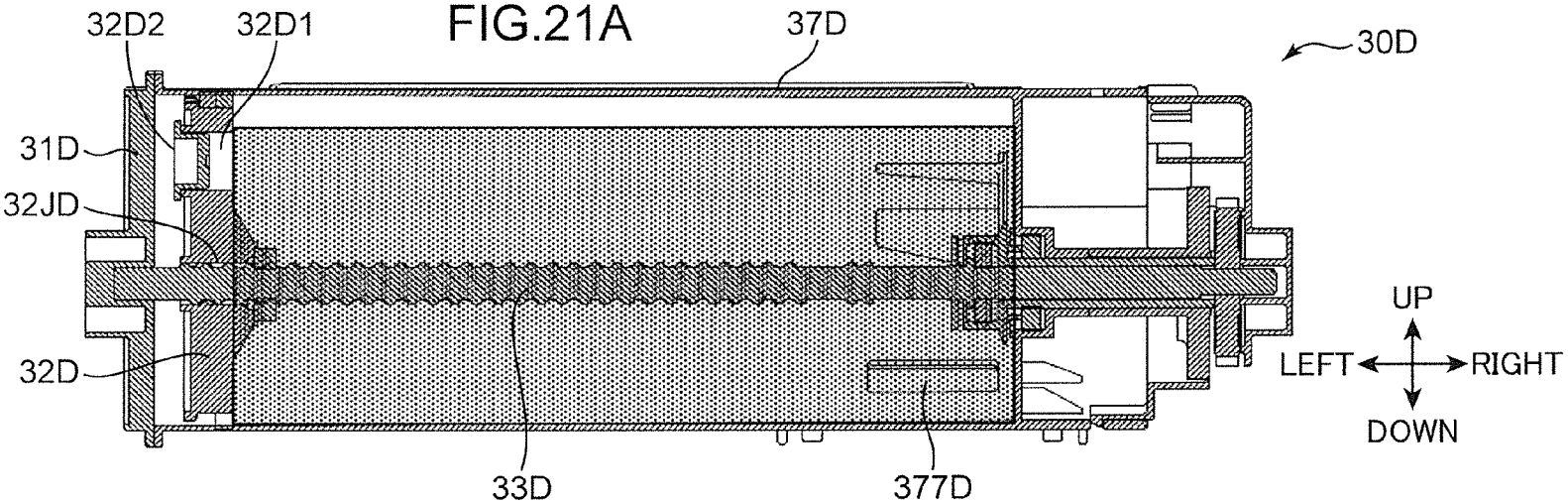
FIG. 21A is a sectional view of another developer storage container to be compared with the developer storage container according to the embodiment of the present invention.
Figure 21B:
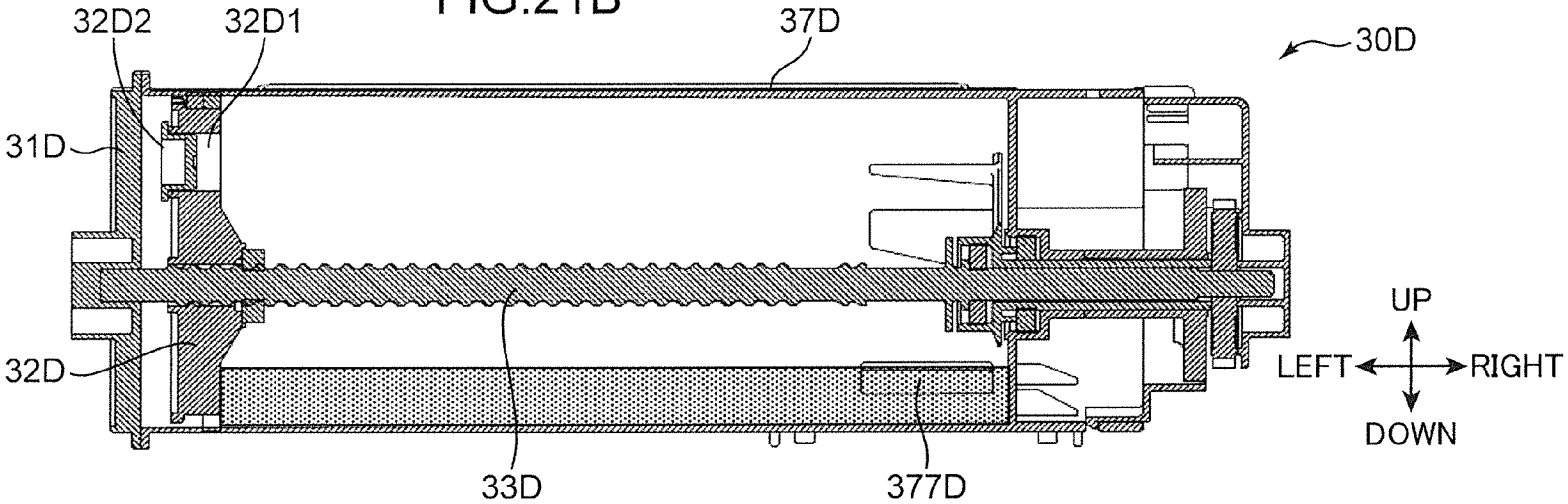
FIG. 21B is a sectional view of the other developer storage container to be compared with the developer storage container according to the embodiment of the present invention.

Further, as described above, the filling port 37G for filling the toner into the container space 37S is opened in the right wall 375 in the present embodiment. FIGS. 21A and 21B are sectional views of another toner container 30D to be compared to the toner container 30 according to the present embodiment. Further, FIG. 22A is similarly a sectional view of the toner container 30D, and FIG. 22B is a sectional view of another toner container 30E to be compared to the toner container 30 according to the present embodiment.

Figure 22A:
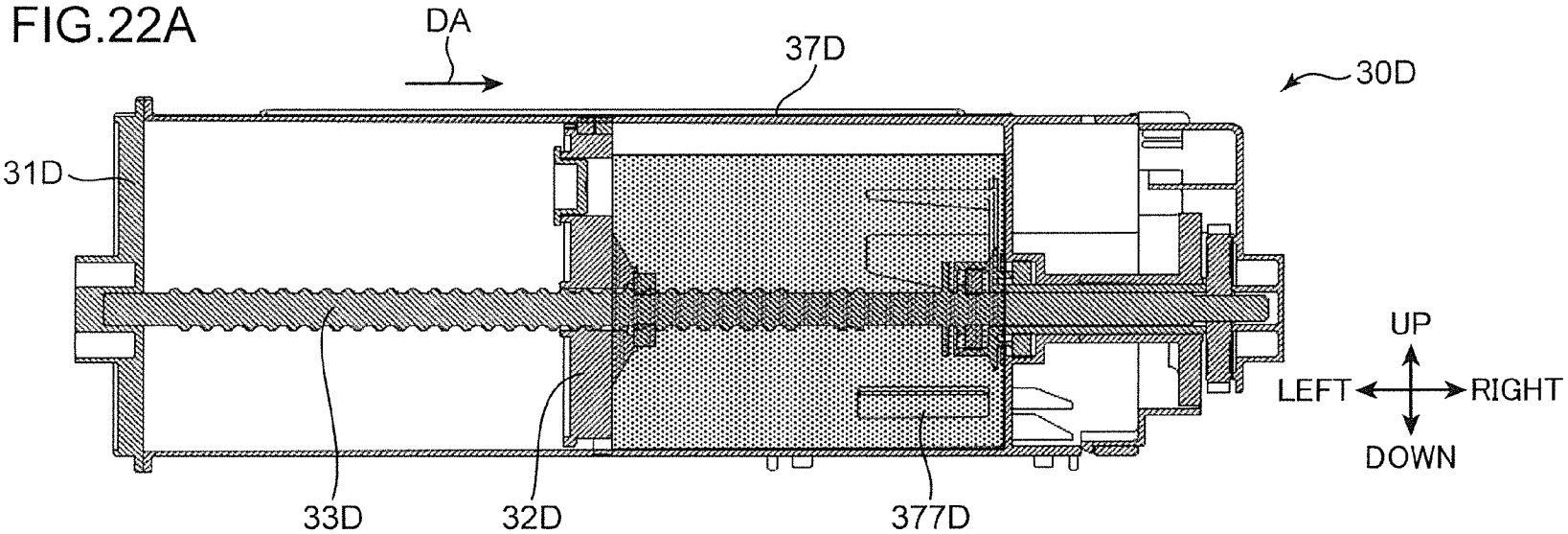
FIG. 22A is a sectional view of the other developer storage container to be compared with the developer storage container according to the embodiment of the present invention.
Figure 22B:
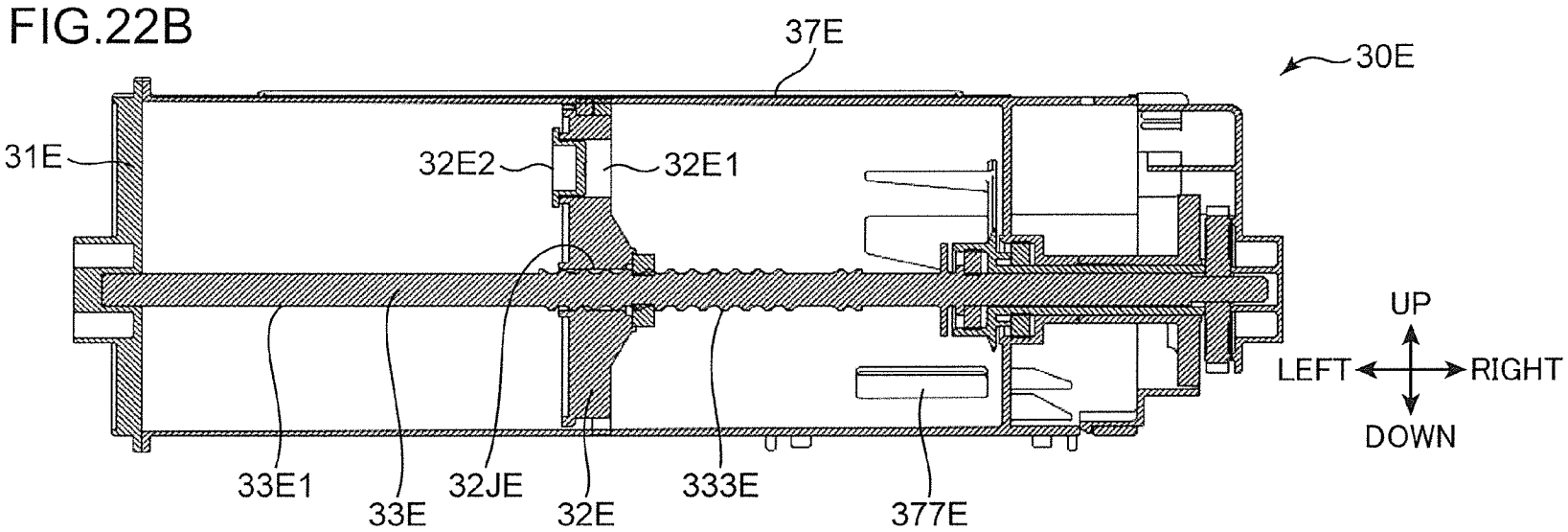
FIG. 22B is a sectional view of the other developer storage container to be compared with the developer storage container according to the embodiment of the present invention.

In the toner container 30D shown in FIGS. 21A, 21B and 22A, a filling port 32D1 for filling toner is opened in a movable wall 32D. In this case, the toner is filled before a lid 31D is welded to a container body 37D.

A bearing portion 32JD allowing the passage of a shaft 33D therethrough is opened in the movable wall 32D. As described above, the rigidity of the movable wall 32D is likely to be reduced if the filling port 32D1 is further opened in the movable wall 32D. If the rigidity of the movable wall 32D is low, the movable wall 32D is easily inclined with respect to the shaft 33D when moving toward a toner discharge port 377D along the shaft 33D. On the other hand, if the filling port 37G is opened on the right wall 375 as in the present embodiment (FIGS. 18A, 18B), only the bearing portion 32J has to be opened in the movable wall 32 and high rigidity of the movable wall 32 is maintained.

Further, in the printer 100, a plurality of filling amounts of toner to be filled into the toner container 30 may be set. As an example, if a plurality of printable sheet numbers are set for each toner container 30, the amount of toner to be filled into the toner container 30 in advance is set according to the printable sheet number. If a large amount of toner is filled in the toner container 30, the toner is filled with the movable wall 32D disposed at the left end as shown in FIG. 21A. On the other hand, if a small amount of toner is filled into the toner container 30D, the toner after filling is distributed near the bottom of the toner container 30D as shown in FIG. 21B. If such a toner container 30D is mounted into the printer 100, the movable wall 32D needs to be moved to a position shown in FIG. 22A prior to the use of the printer 100. As just described, in the toner container 30D, a time for moving the movable wall 32D in the manufacturing process of the printer 100 or initially at a user's place of use is necessary, leading to an increase in the number of manufacturing processes of the printer 100 or an increase of a preparation time at the place of use.

With reference to FIG. 22B, an external thread portion 333E is partly disposed in a central part of a shaft 33E in the first direction in the toner container 30E. An area 33E1 constituted only by a shaft portion where no external thread portion 333E is disposed is set on a left end side of the shaft 33E. In this case, a movable wall 32E can be disposed at a position shown in FIG. 22B in advance while a bearing portion 32JE of the movable wall 32E is passing through the area 33E1. However, in this case, since the toner is filled via a filling port 32E1 in a state shown in FIG. 22B, a filling facility (nozzle) needs to be inserted into the interior of the toner container 30E. As a result, the shape of the filling facility is complicated. Particularly, if such a long and narrow filling nozzle as to reach the filling port 32E1 is disposed, the interior of the nozzle is easily clogged with the toner. Further, since the movable wall 32E easily moves during filling, filling efficiency is reduced. Further, since the position of the movable wall 32E is unstable, it is difficult to weld a filling port cap 32E2 to the filling port 32E1. On the other hand, if the filling port 37G is opened in the right wall 375 as in the present embodiment, the toner can be filled from the side of the right wall 375 having the position constantly fixed regardless of the amount of the toner to be filled. Further, in the assembling process of the toner container 30, the shaft 33 can be mounted into the container body 37 with the movable wall 32 disposed at a predetermined position on the shaft 33 in the first direction. Thus, the toner is filled through the filling port 37G after an initial size of the container space 37S is set in advance. As just described, in the present embodiment, even if a plurality of filling amounts of the toner to be filled into the container space 37S are set and a plurality of initial positions of the movable wall 32 are set, the sharing of the filling facility is realized and the filling operation is stably performed.

<Concerning Movement of Movable Wall>

The toner container 30 is mounted into the container housing portion 109 by a user while the first guide portion 312 of the lid 31 and the second guide portion 391 of the cover 39 are guided by the pair of guide grooves 109A of the developing device 20 (FIGS. 6, 7). When the toner container 30 is mounted into the container housing portion 109, the shutter 20S is moved to open the toner discharge port 377. As a result, the toner discharge port 377 is disposed to face the toner replenishment port 25 from above (FIGS. 4, 5).

Figure 19A:
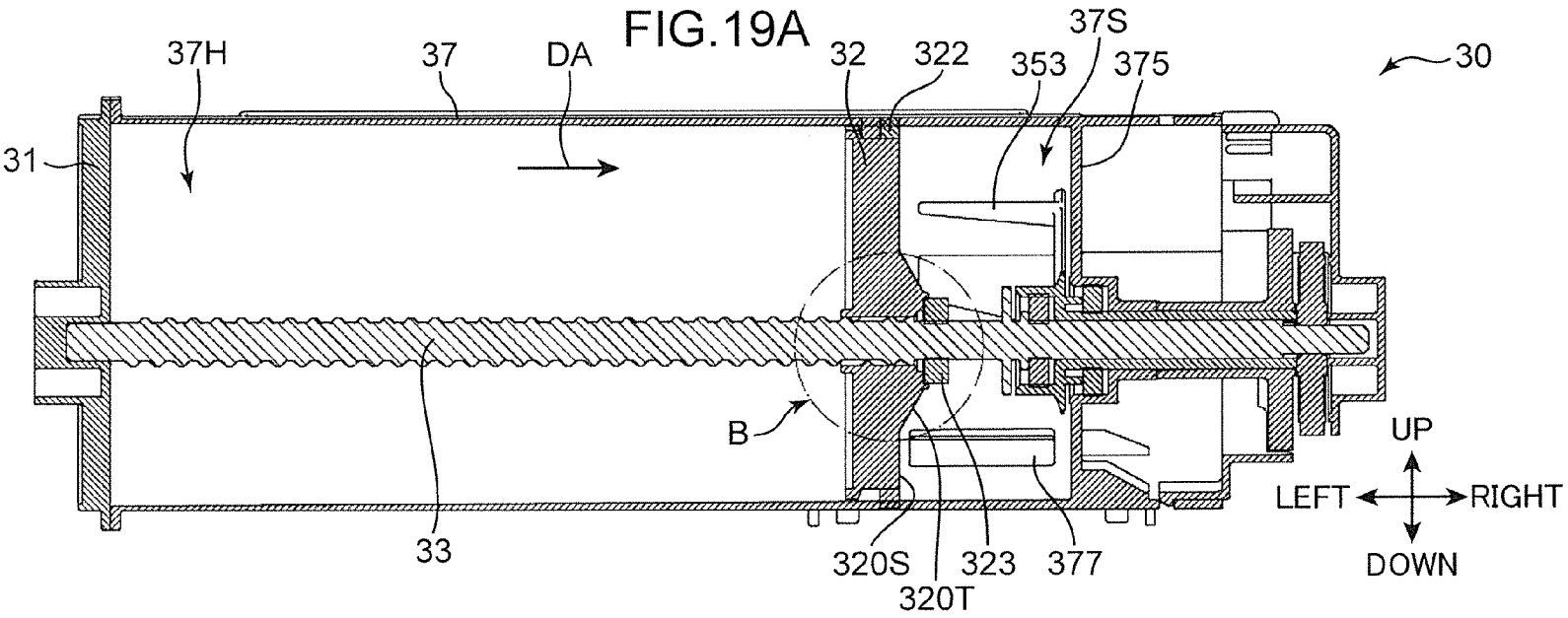
FIG. 19A is a sectional view of the developer storage container according to the embodiment of the present invention.
Figure 19B:
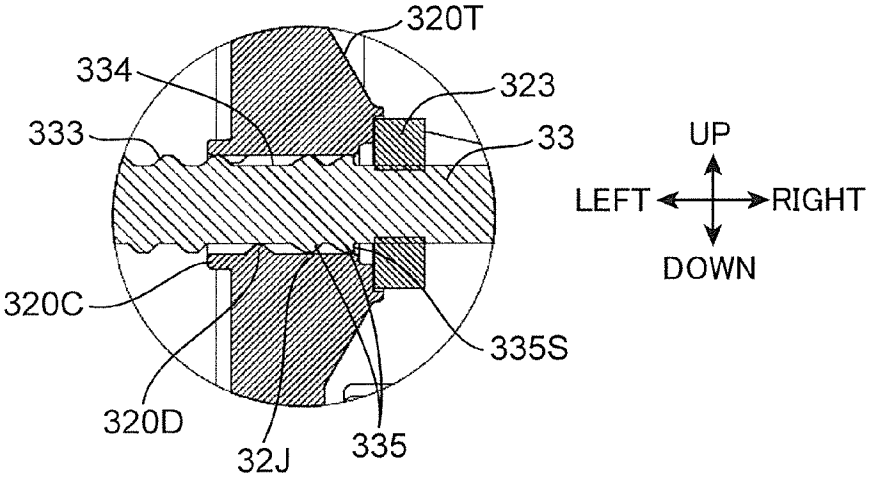
FIG. 19B is an enlarged perspective view enlargedly showing a part of the developer storage container of FIG. 19A.

FIG. 19A is a sectional view showing a state where the movable wall 32 is disposed at the final position in the toner container 30, and FIG. 19B is an enlarged sectional view in an area B of FIG. 19A. It should be noted that FIG. 10 described above is a sectional view showing a state while the movable wall 32 is being moved in the first direction from the initial position. Further, the initial position of the movable wall 32 is set at a position along the lid 31, i.e. to the left of the position of the movable wall 32 shown in FIG. 10.

When a new toner container 30 is mounted into the printer 100, the controller 50 (FIG. 7) drives the first motor M1 to drive and rotate the shaft 33 via the second gear 382 engaged with the third transmission gear 213. As a result, the movable wall 32 moves toward the toner discharge port 377 in the first direction (arrow DA of FIG. 10) by the engagement of the external thread portion 333 of the shaft 33 and the internal thread portion 320D of the movable wall 32. Eventually, when the movable wall 32 moves rightward a predetermined distance from the initial position, the container space 37S is filled with toner and the toner sensor TS outputs a HIGH-signal corresponding to a full state. The controller 50 stops the movable wall 32 upon receiving the HIGH-signal output from the toner sensor TS.

In the present embodiment, the inner circumferential portion 37K of the container body 37 and the outer circumferential portion 32K of the movable wall 32 have a non-true circular shape in a cross-sectional view intersecting with the first direction. Particularly, as shown in FIG. 17A, the inner circumferential portion 37K of the container body 37 is formed by the bottom portion 371, the top plate 372, the front wall 373 and the rear wall 374 of the container body 37. Further, an oblique portion 37TP recessed inwardly of the container body 37 is disposed in an upper end part of the rear wall 334. As a result, the container body 37 is bilaterally asymmetrically shaped with respect to a vertical plane passing through the shaft 33. It should be noted that since the grip portion 37L is disposed on the upper end of the oblique portion 37TP, the user can grip the toner container 30 by holding the grip portion 37L and the front wall 373.

On the other hand, the outer circumferential portion 32K of the movable wall 32 held in close contact with the inner circumferential portion 37K of the container body 37 is also shaped similarly to the inner circumferential portion 37K. Thus, even if a rotational force about the shaft 33 is applied to the movable wall 32 by the engagement of the external thread portion 333 and the internal thread portion 370D, the rotation of the movable wall 33 about the shaft 33 (following the rotation of the shaft 33) is prevented. As a result, the movable wall 32 can be stably moved in the first direction by a rotational drive force of the first motor M1. Further, as described above, the movable wall 32 can be stably moved in the first direction with the outer circumferential portion 32K of the movable wall 32 disposed in close contact with the inner circumferential portion 37K of the container body 37 by the engagement of the external thread portion 333 and the internal thread portion 370D.

It should be noted that a reaction force is applied to the shaft 33 in a direction of an arrow DJ of FIG. 10 (thrust force) when the movable wall 32 moves in the first direction (arrow DA of FIG. 10) by the engagement of the external thread portion 333 and 370D. Accordingly, the end surface of the second shaft end portion 332 of the shaft 33 comes into contact with the contact portion 311 of the lid 31 while the movable wall 32 is moving. As a result, the contact portion 311 has a function of restricting the position of the shaft 33 in the first direction. It should be noted that even if the shaft 31 is strongly laterally pressed by the shaft 33, the lid 31 is ultrasonically welded to the body flange portion 37F (FIG. 9) of the container body 37 in the present embodiment. Thus, the separation of the lid 31 from the container body 37 is prevented. Further, in the present embodiment, the contact portion 311 restricting the position of the shaft 33 is disposed upstream of the movable wall 32 in the first direction. Thus, the presence of the toner between contact parts of the shaft 33 and the contact portion 311 is prevented. Therefore, a rotation failure of the shaft 33 associated with toner fixation in the contact portion 311 is prevented.

As described above, in the present embodiment, the volume replenishment type toner supply method is employed as shown in FIG. 5. Thus, the replenishment toner does not fall from the toner container 30 if the accumulation portion 29 (FIG. 5) in the developing device 20 seals the toner replenishment port 25 from below. On the other hand, when the toner is supplied from the developing roller 21 of the developing device 20 to the photoconductive drum 121 and the toner in the accumulation portion 29 decreases in amount, the toner flows into the developing device 20 via the toner replenishment port 25 through the toner discharge port 377. As a result, the toner around the toner sensor TS disappears in the container space 37S of the toner container 30, wherefore the toner sensor TS outputs a LOW-signal. Upon receiving this signal, the controller 50 drives the first motor M1 to further move the movable wall 32 toward the toner discharge port 377 until the toner sensor TS outputs a HIGH-signal.

It should be noted that, according to a developing operation in the developing device 20, the controller 50 drives the second motor M2 to drive and rotate the developing roller 21 and the like. In tandem with this rotating operation, the stirring member 35 is rotated via the first gear 381 engaged with the second transmission gear 212. As a result, the stirring member 35 disposed on the right end side of the container space 37S rotates about the shaft 33, wherefore the toner above the toner discharge port 377 is stably stirred. Thus, the fluidity of the toner increases and the toner stably falls down through the toner discharge port 377. Particularly, in the present embodiment, the stirring blades 353 project from the stirring supporting portions 353 of the stirring member 35. Thus, the toner around the toner discharge port 377 is actively stirred by turning movements of the stirring blades 353.

If the toner in the container space 37S of the toner container 30 continues to be used, the movable wall 32 eventually reaches the final position shown in FIG. 19A. The movable wall 32 gradually moves in the first direction in this way, whereby the toner in the container space 37S is conveyed to the toner discharge port 377 while being pressed by the movable wall 32. At this time, the container space 37S is gradually reduced in size until the movable wall 32 reaches the final position. Thus, the space where the toner remains gradually disappears in the toner container 30. As a result, the amount of the toner remaining in the container space 37S of the container body 37 is reduced at the end of use as compared to conventional toner containers whose container spaces do not change in volume.

It should be noted that, as shown in FIG. 19A, the movable wall 32 stops on a side slightly upstream of the toner discharge port 377 in the first direction at the final position of the movable wall 32 in the present embodiment. Specifically, with reference to FIG. 19B, the external thread portion 333 and the internal thread portion 320D are disengaged when the movable wall 32 approaches the final position and the bearing portion 32J of the movable wall 32 reaches the movable wall stopping portion 334. As a result, a moving force is no longer transmitted from the shaft 33 to the movable wall 32 and the movable wall 32 stops at the final position. It should be noted that since a space remains above the toner discharge port 377 at this time, a tiny amount of toner remains in this space. However, in the present embodiment, the toner can be stably discharged through the toner discharge port 377 to the end by the driving rotation of the stirring member 35. It should be noted that the toner discharge port 377 is opened at a position slightly displaced upward from the lower end of the container body 37. Even in such a case, the toner remaining in the bottommost portion of the container body 37 is stably discharged through the toner discharge port 377 after being scooped up by the stirring blades 353 (FIGS. 17B, 18B).

Figure 23:
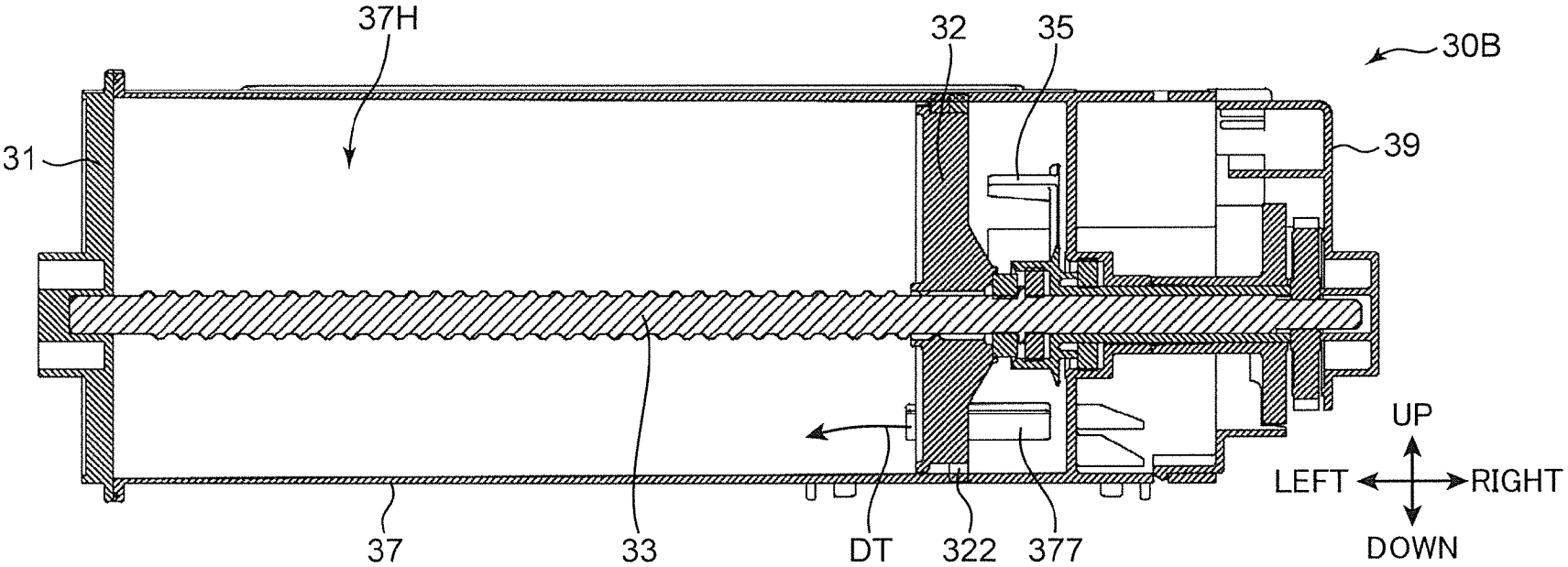
FIG. 23 is a sectional view of another developer storage container to be compared with the developer storage container according to the embodiment of the present invention.

At the final position of the movable wall 32, an upstream end portion of the outer circumferential portion 32K (FIG. 10) of the movable wall 32 is disposed further upstream, in the first direction, of an upstream end portion of the toner discharge port 377 in the first direction. Particularly, in the present embodiment, an upstream end portion of the first seal 32 is disposed further upstream, in the first direction, of the upstream end portion of the toner discharge port 377 in the first direction. FIG. 23 is a sectional view showing a state where a movable wall 32 is disposed at a final position in a toner container 30B to be compared to the toner container 30 according to the present embodiment. In the toner container 30B, an upstream end portion of a first seal 322 is disposed downstream, in the first direction, of an upstream end portion of a toner discharge port 377 in the first direction at the final position of the moving wall 32. Thus, as indicated by an arrow DT of FIG. 23, toner once discharged through the toner discharge port 377 may erroneously flow into an internal space 37H upstream of the movable wall 32. In the present embodiment, such an outflow of the toner is stably prevented by setting a positional relationship between the movable wall 32 at the final position and the toner discharge port 377 as described above. It should be noted that, if the volume replenishment type toner supply method is employed as in the present embodiment, a pressing force of the replenishment toner pressing the accumulation portion 29 from the toner container 30 toward the developing device 20 is lost when the toner in the toner container 30 is used up. In this case, depending on various conditions in the developing device 20, the toner in the developing device 20 may flow back from the toner replenishment port 25 toward the toner discharge port 377. Even in such a case where the toner more easily flows back, the toner is prevented from erroneously flowing into the internal space 37H upstream of the movable wall 32 by the arrangement of the final position of the movable wall 32.

Further, with reference to FIG. 19A, the conveying surface 320S of the movable wall 32 at the first position is disposed upstream of the stirring blades 353 of the stirring member 35 in the first direction while being at a distance.

Thus, the interference of the conveying surface 320S of the movable wall 32 having reached the final position and the stirring member 35 is prevented. Thus, even if the stirring member 35 continues to be rotated to discharge the toner remaining in the container body 37, the stirring member 35 and the movable wall 32 do not rub each other and the aggregation of the toner is prevented from being formed. Further, even if the developing device 20 continues to be used for a certain time and the stirring member 35 continues to be rotated in synchronization with the developing roller 21 with the toner container 30 emptied, the interference of the movable wall 32 and the stirring member 35 is prevented. Further, as described above, the movement of the movable wall 32 is reliably stopped at the final position by the movable wall stopping portion 334 provided on the shaft 33. Thus, the interference of the movable wall 32 and the stirring member 35 is further prevented. Further, at the final position of the movable wall 32 shown in FIG. 19A, the inner wall seal 322 of the movable wall 32 radially biases the inner circumferential portion 37K of the toner container 30 from inside with an elastic force. Thus, the movable wall 32 is stably locked at the final position and the approach of the movable wall 32 toward the stirring member 35 is prevented.

Further, in the present embodiment, as shown in FIG. 19A, upstream end portions of the stirring blades 353 of the stirring member 35 in the first direction are disposed slightly downstream, in the first direction, of the upstream end portion of the toner discharge port 377 in the first direction. It should be noted that the upstream end portions of the stirring blades 353 of the stirring member 35 in the first direction may be disposed at the same position in the first direction as the upstream end portion of the toner discharge port 377 in the first direction. By setting the positions of the stirring blades 353 and the toner discharge port 377 in this way, the toner located around the toner discharge port 377 is stably stirred and discharged. Furthermore, since the stirring blades 353 do not project further toward the upstream side in the first direction than the toner discharge port 377, the final position of the movable wall 32 can be brought as close to the toner discharge port 377 as possible.

Furthermore, in the present embodiment, the conveying surface 320S of the movable wall 32 has the tapered surface 320T (FIG. 19A). The shaft seal 323 is disposed on the tip portion of the tapered surface 320T. Further, at the final position of the movable wall 32, a downstream end portion of the shaft seal 323 in the first direction is disposed further downstream, in the first direction, of the upstream end portion of the toner discharge port 377. By setting the final position of the movable wall 32 such that the tapered surface 320T and the shaft seal 323 enter a space radially inwardly of the stirring blades 353 in this way, the final position of the movable wall 32 can be brought further closer to the toner discharge port 377. Thus, the container space 37S at the end of use of the toner container 30 can be made as small as possible. Further, the movable wall stopping portion 334 and the movable wall supporting portions 335 of the shaft 33 can be disposed with a sufficient margin along the first direction to face the bearing portion 32J of the movable wall 32. In other words, by providing the tapered surface 320T, a thickness of the movable wall 32 in the first direction increases. Thus, an area for disposing the movable wall stopping portion 334 and the movable wall supporting portions 335 can be ensured to be long in the first direction. Furthermore, by providing the tapered surface 320T, the shaft seal 323 can be disposed downstream of the internal thread portion 320D in the first direction while being at a distance. Thus, excessive entrance of the toner to a space defined by the internal thread portion 320D is prevented.

Figure 24A:
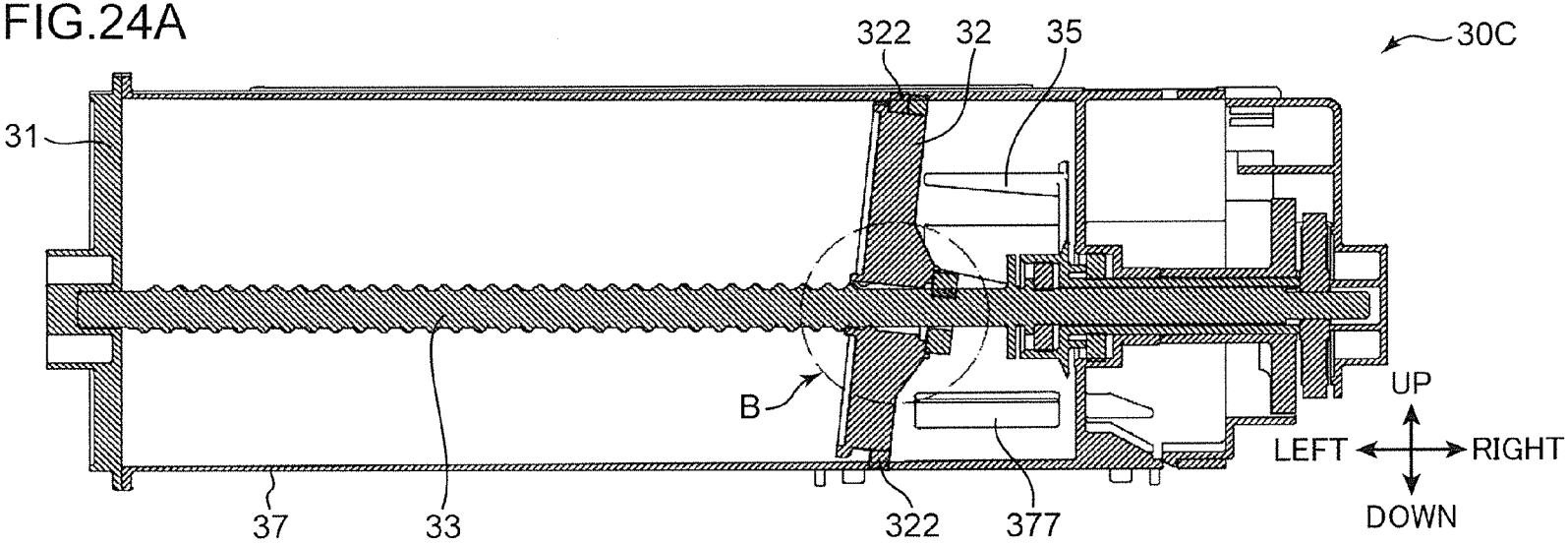
FIG. 24A is a sectional view of the other developer storage container to be compared with the developer storage container according to the embodiment of the present invention.
Figure 24B:
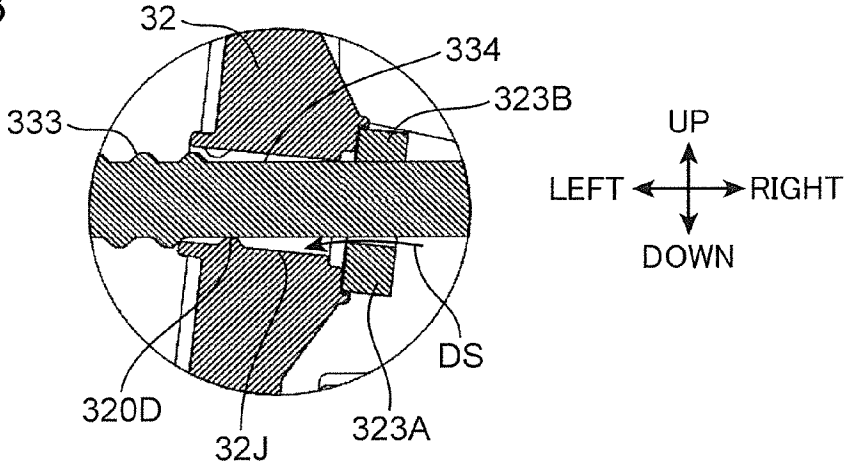
FIG. 24B is an enlarged sectional view enlargedly showing a part of the developer storage container of FIG. 24A.

Further, in the present embodiment, the bearing portion 32J is supported by the movable wall supporting portions 335 disposed downstream of the movable wall stopping portion 334 in the first direction in addition to by a downstream end portion of the external thread portion 333 in the first direction. Thus, the inclination of the movable wall 32 having reached the final position with respect to the shaft 33 is suppressed. Particularly, the inclination of the conveying surface 320S of the movable wall 32 with respect to the first direction is reduced. FIG. 24A is a sectional view of the toner container 30C to be compared to the toner container 30 according to the present embodiment. FIG. 24B is an enlarged sectional view enlargedly showing an area B of FIG. 24A. The toner container 30C differs from the toner container 30 in not including the movable wall supporting portions 335 in the present embodiment. As shown in FIG. 24B, when a movable wall 32 of the toner container 30C reaches a final position, an internal thread portion 320D is disengaged from an external thread portion 333. At this time, since there is a large gap between the inner circumferential surface of a bearing portion 32J and the outer circumferential surface of a movable wall stopping portion 334, the movable wall 32 is inclined as shown in FIG. 24B. At this time, a lower part 323A of a shaft seal 323 disposed on the tip of the bearing portion 32J is separated from the movable wall stopping portion 334 and toner easily flows out to a side upstream of the movable wall 32 in the first direction after entering the bearing portion 32J as indicated by an arrow DS. Similarly, since an upper part 323B of the shaft seal 323 is excessively pressed against the movable wall stopping portion 334, the shaft seal 323 is largely deformed. As a result, the toner similarly easily enters the bearing portion 32J. Further, if the movable wall 32 is inclined with respect to the shaft 33, the compression amount of an inner wall seal 322 arranged in an outer circumferential portion 32K of the movable wall 32 also changes. As a result, the toner easily flows to the upstream side in the first direction through a clearance between a container body 37 and the movable wall 32.

On the other hand, in the present embodiment, the shaft 33 includes the movable wall supporting portions 335. Thus, the inclination of the movable wall 32 is suppressed and uneven deformation of the inner wall seal 322 and the shaft seal 323 is reduced. As a result, the toner is prevented from flowing out to the side upstream of the movable wall 32 via a clearance between the movable wall 32 and the inner circumferential portion 37K of the container body 37 and the body bearing portion 37J. Further, the interference between the conveying surface 320S of the movable wall 32 at the final position and the stirring member 35 is prevented by preventing the inclination of the movable wall 32.

It should be noted that the projecting height of the movable wall supporting portions 335 from the shaft 33 is desirably equal to or slightly larger than the height of the ridge of the external thread portion 333. In this case, the movable wall supporting portions 335 can reliably support the bearing portion 32J. Further, since the movable wall supporting portions 335 have a ring shape by being disposed along the circumferential direction on the circumferential surface of the shaft 33, the bearing portion 32J is stably supported on the movable wall supporting portions 335 over the entire circumference.

Further, since a plurality of the movable wall supporting portions 335 are disposed along the first direction as shown in FIGS. 13B and 19B, the bearing portion 32J is stably supported in a predetermined range along the first direction. Further, the second supporting portion 335B, out of the movable wall supporting portions 335, has the side end surface 335C (FIG. 19B) perpendicular to the first direction. Thus, the movable wall stirring supporting portions 335 can support the bearing portion 32J on the side as downstream as possible in the first direction. As a result, the final position of the movable wall 32 can be brought further closer to the toner discharge port 377.

It should be noted that although the volume replenishment type toner supply method is employed in the above embodiment, the present invention is not limited to this. An unillustrated toner sensor may be disposed in the developing device 20. When a reduction in the amount of toner in the developing device 20 is detected by the toner sensor, the first motor M1 is driven by the controller 50 and the movable wall 32 is moved in the first direction. As a result, the toner falls down through the toner discharge port 377 and flows into the developing device 20.

Further, although the bearing portion 32J is disposed substantially in the central part of the movable wall 32 in the above first embodiment, the present invention is not limited to this. The bearing portion 32J may be disposed in another area of the movable wall 32. The bearing portion 32 may be disposed upstream of the movable wall 32 and the corresponding shaft 33 may extend along the first direction in an upper part in the container body 37. In this case, since a pressure of the toner applied to the shaft seal 323 (FIGS. 19A, 19B) decreases, even higher sealing performance of the shaft seal 323 is maintained.

Further, although the movable wall 32 moves from the side of the lid 31 toward the right wall 375 in the above embodiment, the present invention is not limited to this. The toner discharge port 377 may be open on the side of the lid 31 and the movable wall 32 may move from the side of the right wall 375 toward the lid 31. Further, the shape of the stirring member 35 rotated above the toner discharge port 377 is not limited to that of the above embodiment. The stirring member 35 may have another shape capable of stirring the toner around the toner discharge port 377.

Figure 20:
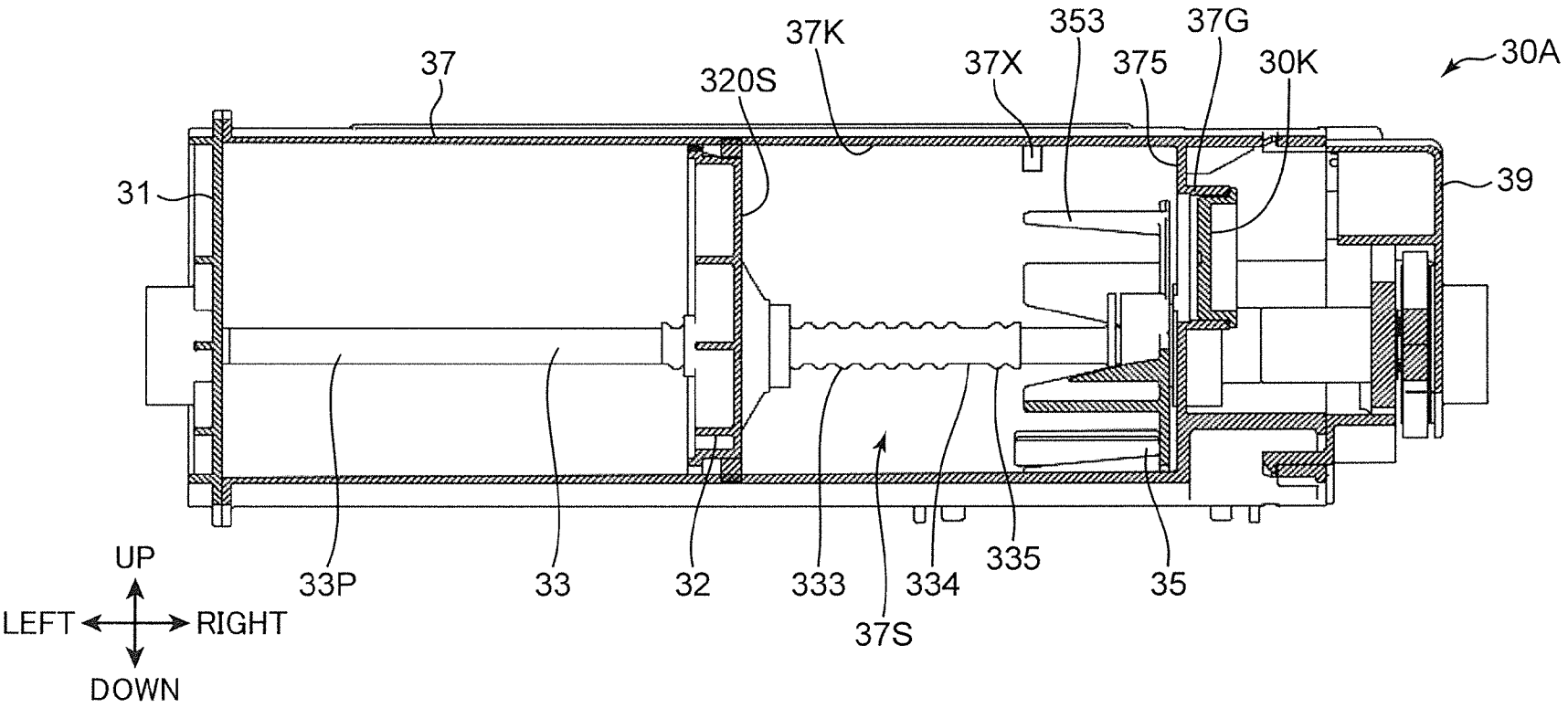
FIG. 20 is a sectional view of a developer storage container according to a modification of the present invention.

Further, in the above embodiment, the movable wall supporting portions 335 provided on the shaft 33 function as an inclination suppressing mechanism for maintaining the posture of the movable wall 32 and suppressing the inclination. The present invention is not limited to this. FIG. 20 is a sectional view of a toner container 30A according to a modification of the present invention. This modification differs from the previous embodiment in that the toner container 30A includes a projecting member 37X instead of the movable wall supporting portions 335 according the previous embodiment. The projecting member 37X is a projection projecting radially inwardly from an inner circumferential portion 37K of a container body 37. In this modification, when a movable wall 32 reaches a final position corresponding to a movable wall stopping portion 334, a conveying surface 320S comes into contact with the projecting member 37X, thereby suppressing the inclination of the movable wall 32 with respect to the first direction.

Furthermore, as shown in FIG. 20, the projecting member 37X projects downward from the inner circumferential portion 37K of the container body 37 above a shaft 33. Thus, the projecting member 37X does not obstruct the flow of toner toward a toner discharge port 377 as compared to the case where a projecting member is disposed on a bottom side of the container body 37.

It should be noted that, in the case of integrally molding the projecting member 37X to the container body 37, the projecting member 37X of FIG. 20 may be in the form of a rib extending in the first direction until reaching a right wall 375. In this case, the rib-like projecting member is formed along the first direction when the container body 37 is pulled out from a mold.

Furthermore, in the present modification, the shaft 33 includes a shaft guiding portion 33P (FIG. 20). The shaft guiding portion 33P is an area in a predetermined range on a left end side of the shaft 33, the external thread portion 333 mixing on the shaft guiding portion 33P. In the toner container 30A, an initial position of the movable wall 32 is set at the position of the movable wall 32 shown in FIG. 20. A toner filling amount of the toner container 30A is about half that of the toner container 30 according to the previous embodiment. In the assembling stage of the toner container 30A, the movable wall 32 passes the shaft guiding portion 33P of the shaft 33, whereby the movable wall 32 is quickly arranged at the initial position without rotating the shaft 33. In this way, the position of the upstream end portion of the external thread portion 333 formed on the shaft 33 in the first direction and the initial position of the movable wall 32 are set according to the filling amount of the toner contained in the container space 37S. The position of the external thread portion 333 of the shaft 33 is set such that the upstream end portion of the external thread portion 333 in the first direction is located more upward in the first direction when the toner filled in the container space 37S has a second weight as in the toner container 30 than when the toner filled in the container space 37S has a first weight smaller than the second weight as in the toner container 30A. As a result, the volume of the container space 37S can be set according to the toner filling amount set in advance.

The invention claimed is:

1. A developer storage container comprising:

a container body including opposite first and second ends spaced apart in an axial direction, an inner circumferential portion defining a tubular internal space extending along the axial direction, a first wall in proximity to the first end of the container body and defining a first end surface of the internal space in the axial direction;

a second wall configured to be mounted in proximity to the second end of the container body and being opposed to the first wall in the axial direction so as to close the internal space;

a developer discharge port disposed adjacent one of the first and second walls, the developer discharge port being opened in the container body to communicate with the internal space and configured to discharge developer;

a movable wall in the internal space and including an outer circumferential portion slidably disposed in close contact with the inner circumferential portion of the container body and further including a conveying surface defining a container space for containing the developer in cooperation with the inner circumferential portion of the container body, the movable wall being configured to move in the axial direction in the internal space from an initial position in proximity to one of the first and second ends to a final position in proximity to the other of the first and second ends while conveying the developer contained in the container space toward the developer discharge port; and a stirring member configured to stir the developer in the container space around the developer discharge port;

an upstream end of the outer circumferential portion of the movable wall in the axial direction being upstream, in the axial direction of an upstream end of the developer discharge port in the axial direction when the movable wall is at the final position, and the conveying surface of the movable wall being spaced from the stirring member when the movable wall is at the final position;

a shaft including a first engaging portion provided on an outer circumferential surface thereof and spirally projecting along the axial direction, and a first end rotatably supported on the first wall and a second end rotatably supported on the second wall to extend in the axial direction in the internal space;

a bearing arranged on the movable wall, the bearing including a second engaging portion projecting from an inner circumferential surface of the bearing and engaged with the first engaging portion, and the bearing allowing a passage of the shaft therethrough;

a drive transmitting portion configured to transmit a rotational drive force to the shaft;

a movable wall stopping portion which is a partially missing of the first engaging portion on a downstream side of the shaft in the axial direction in the internal space; and a plurality of ring-shaped movable wall supporting portions disposed downstream of the movable wall stopping portion in the axial direction and radially projecting from the circumferential surface of the shaft;

wherein the movable wall moves in the axial direction along the shaft by the engagement of the first and second engaging portions when the shaft portion is rotated, and the first and second engaging portions are disengaged and the movable wall stops at the final position when the movable wall approaches the final position and the bearing reaches the movable wall stopping portion thereby the plurality of ring-shaped movable wall supporting portions suppressing the inclination of the conveying surface of the movable wall with respect to the axial direction.

2. A developer storage container according to claim 1, further comprising a seal configured to form the outer circumferential portion of the movable wall and configured to be compressively deformed between the inner circumferential portion of the container body and the movable wall, wherein:

an upstream end of the seal in the axial direction is disposed upstream, in the axial direction, of the upstream end portion of the developer discharge port in the axial direction at the final position of the movable wall.

3. A developer storage container according to claim 1, wherein the stirring member rotates about an axis of the shaft above the developer discharge port.

4. A developer storage container according to claim 3, wherein:

the stirring member includes:

a supporting portion disposed to intersect the axial direction along the first wall or the facing wall and configured to rotate about the axis of the shaft; and a blade projecting toward the upstream side in the axial direction from the supporting portion and configured to turn above the developer discharge port; and an upstream end of the blade in the axial direction being disposed at the same position, or downstream, in the axial direction, as the upstream end portion of the developer discharge port in the axial direction.

5. A developer storage container according to claim 1, comprising a cleaning member disposed downstream of the second engaging portion in the axial direction in the bearing and configured to be in contact with the first engaging portion of the shaft.

6. A developer storage container according to claim 5, wherein the cleaning member has a ring shape and is held in contact with the shaft over the entire circumference of the shaft.

7. A developer storage container according to claim 5, wherein:

the conveying surface of the movable wall has a tapered surface inclined toward the downstream side in the axial direction to surround around the shaft; and the cleaning member is disposed on a tip of the tapered surface.

8. A developer storage container according to claim 5, wherein a downstream end portion of the cleaning member in the axial direction is disposed downstream, in the axial direction, of the upstream end portion of the developer discharge port in the axial direction at the final position of the movable wall.

9. An image forming device, comprising:

the developer storage container of claim 1;

an image carrier having a surface for allowing an electrostatic latent image to be formed thereon and configured to carry a developer image;

a developing device configured to supply the developer supplied from the developer storage container to the image carrier; and a transfer section configured to transfer the developer image to a sheet from the image carrier.

10. An image forming device according to claim 9, wherein the developing device includes:

a housing having a developer conveyance passage for allowing the developer to be conveyed in a predetermined conveying direction;

a developer replenishment port opened in the housing below the developer discharge port and configured to receive the developer into the developer conveyance passage from the developer storage container;

a developer conveying member arranged in the developer conveyance passage and configured to convey the developer in the conveying direction; and a conveying ability reducing portion configured to partially reduce an ability of the developer conveying member to convey the developer in the conveying direction on a downstream side of the developer replenishment port in the conveying direction.

* * * * *